US007621098B2

(12) United States Patent
Reinert, Sr.

(10) Patent No.: US 7,621,098 B2
(45) Date of Patent: Nov. 24, 2009

(54) SEGMENTED FOUNDATION INSTALLATION APPARATUS AND METHOD

(75) Inventor: Gary L. Reinert, Sr., Pittsburgh, PA (US)

(73) Assignee: MFPF, Inc., Las Vegas, NV (US)

( * ) Notice: Subject to any disclaimer, the term of this patent is extended or adjusted under 35 U.S.C. 154(b) by 1558 days.

(21) Appl. No.: 10/294,429

(22) Filed: Nov. 14, 2002

(65) Prior Publication Data

US 2003/0115810 A1 Jun. 26, 2003

Related U.S. Application Data

(60) Provisional application No. 60/331,879, filed on Nov. 20, 2001.

(51) Int. Cl.
*E04B 1/00* (2006.01)

(52) U.S. Cl. ..... 52/742.1; 52/160; 52/162; 405/237; 405/229; 405/231

(58) Field of Classification Search ..... 52/742.1, 52/160, 162, 156, 161, 165; 405/237, 239, 405/229, 231

See application file for complete search history.

(56) References Cited

U.S. PATENT DOCUMENTS

| | | | |
|---|---|---|---|
| 81,682 | A | 9/1868 | Porter |
| 367,411 | A | 8/1887 | Kilmer |
| 486,973 | A | 11/1892 | Knox |
| 543,802 | A | 7/1895 | English |
| 589,980 | A | 9/1897 | Randolph |
| 606,558 | A | 6/1898 | Ketchum |
| 612,052 | A | 10/1898 | McMullen |
| 676,968 | A | 6/1901 | Stanton |
| 684,838 | A | 10/1901 | Matheison |
| 743,150 | A | 11/1903 | Cooper |
| 756,374 | A | 4/1904 | Justus |

(Continued)

FOREIGN PATENT DOCUMENTS

| | | | |
|---|---|---|---|
| AT | 363044 | B | 7/1981 |

(Continued)

OTHER PUBLICATIONS

Hough; Basic Soils Engineering; Jan. 1, 1957; Chapters 5, 6, 10, 11, 14.

(Continued)

*Primary Examiner*—Laurie K Cranmer
(74) *Attorney, Agent, or Firm*—The Webb Law Firm

(57) ABSTRACT

Vertical segmented support and media consolidation plates swingably mounted about pivot points on the vertical segmented support, incorporate media-facing surfaces swingable outwardly from the vertical support means into the surrounding media. Varying segmented lengths form the segmented vertical segmented support. The novel segmented apparatus and installation method further provide for a centering collar 113, an anchor positioning means at level force pivoting plates 194, and pivoting plates 194 positioned 40-50 degrees from vertical. A frusto-cone 197 dx equal to a predetermined distance of one-half inch forms gap 204. The novel method installs an anchor and foundation device in the earth by preparing a hole in the earth, lowering into the hole a segmented anchor or foundation device having swingable media facing plates, and applying force to swing the plates outwardly into the surrounding media.

20 Claims, 8 Drawing Sheets

U.S. PATENT DOCUMENTS

| | | | | |
|---|---|---|---|---|
| 787,017 | A | | 4/1905 | Witmer |
| 793,289 | A | | 6/1905 | Futhey |
| 817,044 | A | | 4/1906 | Cissna |
| 899,274 | A | | 9/1908 | Thomas |
| 948,532 | A | | 2/1910 | Stocking |
| 963,791 | A | | 7/1910 | Miller |
| 978,505 | A | | 12/1910 | Stewart |
| 1,004,112 | A | | 9/1911 | Upchurch |
| 1,173,806 | A | | 2/1916 | Johnson |
| 1,214,679 | A | | 2/1917 | Hindmarsh |
| 1,217,128 | A | | 2/1917 | White |
| 1,330,233 | A | | 2/1920 | Blackburn |
| 1,548,541 | A | | 8/1925 | McClease |
| 1,569,857 | A | | 1/1926 | Farb |
| 1,598,407 | A | | 8/1926 | Tomkinson |
| 1,611,935 | A | | 12/1926 | Mitchell |
| 1,617,043 | A | | 2/1927 | Carter |
| 1,658,155 | A | | 2/1928 | Blackburn |
| 1,667,970 | A | | 5/1928 | Herrmann |
| 1,807,488 | A | | 5/1931 | Michalicek |
| 1,858,926 | A | | 5/1932 | Grau et al. |
| 1,948,856 | A | | 2/1934 | Heinrich |
| 1,973,995 | A | | 9/1934 | Pieper |
| 1,994,520 | A | | 3/1935 | Johns et al. |
| 2,038,506 | A | | 4/1936 | Cadieux |
| 2,176,566 | A | | 10/1939 | Dillon |
| 2,225,165 | A | | 12/1940 | Dunlap, Jr. |
| 2,285,889 | A | | 6/1942 | Blanchard |
| 2,362,556 | A | | 11/1944 | Hubbard |
| 2,490,465 | A | | 12/1949 | Ogburn |
| 2,678,540 | A | | 5/1954 | Lorenz |
| 2,755,734 | A | * | 7/1956 | Smith ..... 181/0.5 |
| 2,779,240 | A | | 1/1957 | Gaydos |
| 2,799,479 | A | | 7/1957 | Kammerer |
| 2,811,575 | A | | 10/1957 | Guerrero |
| 2,886,630 | A | | 5/1959 | Gill |
| 2,942,426 | A | | 6/1960 | Stoll |
| 2,955,430 | A | | 10/1960 | Alston |
| 2,958,404 | A | | 11/1960 | Smith |
| 2,982,103 | A | | 5/1961 | Revesz et al. |
| 3,011,597 | A | | 12/1961 | Galloway et al. |
| 3,011,598 | A | | 12/1961 | Galloway et al. |
| 3,015,720 | A | | 1/1962 | Silverman |
| 3,027,416 | A | | 3/1962 | Kissel |
| 3,056,477 | A | | 10/1962 | Wooley |
| 3,066,217 | A | | 11/1962 | McDonald |
| 3,066,769 | A | | 12/1962 | Pasquale |
| 3,114,892 | A | | 12/1963 | Finch |
| 3,118,284 | A | | 1/1964 | Cobi |
| 3,131,544 | A | | 5/1964 | Thornley |
| 3,141,059 | A | | 7/1964 | Lang |
| 3,187,858 | A | | 6/1965 | Des Champs |
| 3,206,373 | A | | 9/1965 | Dupuy |
| 3,214,918 | A | | 11/1965 | Binnings |
| 3,222,842 | A | | 12/1965 | Luedloff et al. |
| D204,269 | S | | 4/1966 | Naudus, Jr. |
| 3,263,853 | A | | 8/1966 | Smith |
| 3,279,136 | A | | 10/1966 | Smith |
| 3,342,444 | A | | 9/1967 | Nelson |
| 3,345,040 | A | | 10/1967 | RiveIli |
| 3,390,224 | A | | 6/1968 | Wyatt |
| 3,432,977 | A | | 3/1969 | Scholl |
| 3,463,913 | A | | 8/1969 | Shavalier |
| 3,466,380 | A | | 9/1969 | Baumgartner et al. |
| 3,485,933 | A | | 12/1969 | Flachbarth |
| 3,499,630 | A | | 3/1970 | Dashio |
| 3,512,319 | A | | 5/1970 | Piacentino |
| 3,519,726 | A | | 7/1970 | Ewing |
| 3,521,413 | A | | 7/1970 | Scott et al. |
| 3,525,187 | A | | 8/1970 | Vincent |
| 3,565,276 | A | | 2/1971 | O'Brien et al. |
| 3,570,258 | A | | 3/1971 | Fuller |
| 3,621,910 | A | | 11/1971 | Sanford et al. |
| 3,630,037 | A | | 12/1971 | Howard |
| 3,637,244 | A | | 1/1972 | Strizki |
| 3,680,274 | A | | 8/1972 | Deike |
| 3,685,301 | A | | 8/1972 | Heacox |
| 3,763,610 | A | | 10/1973 | Ballew |
| 3,797,260 | A | | 3/1974 | Webb |
| 3,805,055 | A | | 4/1974 | Cassey |
| 3,837,752 | A | | 9/1974 | Shewchuk |
| 3,855,745 | A | | 12/1974 | Patterson et al. |
| 3,864,923 | A | | 2/1975 | Turzillo |
| 3,869,003 | A | | 3/1975 | Yamada et al. |
| 3,942,368 | A | | 3/1976 | Hoyt |
| 3,946,601 | A | | 3/1976 | Yizhaki |
| 3,951,556 | A | | 4/1976 | Strizki |
| 3,967,906 | A | | 7/1976 | Strizki |
| 3,969,853 | A | | 7/1976 | Deike |
| 4,007,564 | A | | 2/1977 | Chisholm |
| 4,015,433 | A | * | 4/1977 | Shibata ..... 405/259.5 |
| 4,023,314 | A | | 5/1977 | Tanner |
| 4,044,908 | A | | 8/1977 | Dauberger |
| 4,071,970 | A | | 2/1978 | Strizki |
| 4,083,191 | A | | 4/1978 | Donnelly |
| 4,104,711 | A | | 8/1978 | Carter |
| 4,126,403 | A | | 11/1978 | Sweeney et al. |
| 4,154,037 | A | | 5/1979 | Anderson |
| 4,160,613 | A | | 7/1979 | Stanwick |
| 4,189,879 | A | | 2/1980 | Patterson |
| 4,193,459 | A | | 3/1980 | Engstrom |
| 4,225,269 | A | | 9/1980 | Matsui |
| 4,236,843 | A | | 12/1980 | Chisholm |
| 4,252,472 | A | | 2/1981 | Moraly |
| 4,269,010 | A | | 5/1981 | Glass |
| 4,296,821 | A | | 10/1981 | Larson |
| 4,302,799 | A | | 11/1981 | Behrens |
| 4,315,429 | A | | 2/1982 | Morozov et al. |
| 4,343,033 | A | | 8/1982 | Suzuki |
| 4,344,721 | A | | 8/1982 | Goldsmith |
| 4,346,254 | A | | 8/1982 | Borin et al. |
| 4,351,136 | A | | 9/1982 | Fuller |
| 4,382,274 | A | | 5/1983 | De Backer et al. |
| 4,393,440 | A | | 7/1983 | Yperman |
| 4,448,444 | A | | 5/1984 | Toussaint |
| 4,453,863 | A | | 6/1984 | Sutton et al. |
| 4,507,715 | A | | 3/1985 | Wedding |
| 4,528,786 | A | | 7/1985 | Dinitz et al. |
| 4,530,190 | A | | 7/1985 | Goodman |
| 4,547,106 | A | | 10/1985 | Lipsker |
| 4,591,466 | A | | 5/1986 | Murray et al. |
| 4,592,178 | A | | 6/1986 | Lu |
| 4,593,500 | A | | 6/1986 | Watson |
| 4,603,520 | A | | 8/1986 | Deike |
| 4,622,435 | A | | 11/1986 | Trainor et al. |
| 4,626,138 | A | | 12/1986 | Boyes |
| 4,637,758 | A | | 1/1987 | Tamaki et al. |
| 4,648,751 | A | | 3/1987 | Coleman |
| 4,697,394 | A | | 10/1987 | Lu ..... 52/162 |
| 4,721,418 | A | | 1/1988 | Queen |
| 4,801,128 | A | | 1/1989 | Taylor |
| 4,809,788 | A | | 3/1989 | Nelson |
| 4,813,496 | A | | 3/1989 | Rohweller et al. |
| 4,843,785 | A | | 7/1989 | Sero et al. ..... 52/160 |
| 4,858,877 | A | | 8/1989 | Carter |
| 4,882,891 | A | | 11/1989 | Sero et al. ..... 52/742 |
| 4,923,319 | A | | 5/1990 | Dent |
| 4,926,592 | A | | 5/1990 | Nehls |
| 4,974,997 | A | | 12/1990 | Sero et al. ..... 405/231 |
| 5,004,366 | A | | 4/1991 | Simmons |
| 5,018,905 | A | | 5/1991 | Kinder |
| 5,029,054 | A | | 7/1991 | Trainor |
| 5,055,984 | A | | 10/1991 | Hung et al. |
| 5,082,231 | A | | 1/1992 | Knowles |

| | | | | | |
|---|---|---|---|---|---|
| 5,088,683 | A | | 2/1992 | Briden | |
| 5,104,264 | A | | 4/1992 | Castagner et al. | |
| 5,108,068 | A | | 4/1992 | Gingras | |
| 5,117,914 | A | | 6/1992 | Blandford | |
| 5,125,194 | A | | 6/1992 | Granger | |
| 5,145,286 | A | | 9/1992 | Summers | |
| 5,232,268 | A | | 8/1993 | Dengler et al. | |
| 5,234,290 | A | * | 8/1993 | Collins | 405/249 |
| 5,255,480 | A | | 10/1993 | Alsop | |
| 5,269,107 | A | | 12/1993 | Klemm | |
| 5,297,013 | A | | 3/1994 | Hall et al. | |
| 5,460,231 | A | | 10/1995 | Collins | |
| 5,474,408 | A | | 12/1995 | Dinitz et al. | |
| 5,541,362 | A | | 7/1996 | Reinert, Sr. | |
| 5,544,978 | A | | 8/1996 | Albers | |
| 5,570,975 | A | | 11/1996 | Reinert, Sr. | 405/232 |
| 5,582,477 | A | | 12/1996 | Reinert, Sr. | |
| 5,594,201 | A | | 1/1997 | Reinert, Sr. | |
| 5,596,845 | A | | 1/1997 | Strizki | |
| 5,622,015 | A | * | 4/1997 | Collins | 52/160 |
| 5,660,504 | A | | 8/1997 | Reinert, Sr. | 405/232 |
| 5,733,068 | A | | 3/1998 | Reinert, Sr. | 405/232 |
| 5,797,704 | A | * | 8/1998 | Collins | 405/237 |
| 5,944,452 | A | | 8/1999 | Reinert, Sr. | 405/232 |
| 5,992,123 | A | * | 11/1999 | Kies | 52/719 |
| 6,056,471 | A | | 5/2000 | Dinitz | |
| 6,210,077 | B1 | | 4/2001 | Kondo | |
| 6,318,933 | B1 | | 11/2001 | De Medeiros, Jr. et al. | |
| 6,363,776 | B1 | | 4/2002 | Reinert, Sr. | 73/84 |
| 6,527,407 | B2 | | 3/2003 | Gluck | |
| 6,872,883 | B2 | | 3/2005 | Ginsburg | |
| 7,128,308 | B2 | | 10/2006 | Marsh et al. | |
| 2002/0095976 | A1 | | 7/2002 | Reinert, Sr. | |

FOREIGN PATENT DOCUMENTS

| | | | |
|---|---|---|---|
| AU | 217160 | | 5/1957 |
| BE | 716501 | A | 11/1968 |
| BE | 837976 | A1 | 5/1976 |
| DE | 265573 | C | 8/1912 |
| DE | 1129895 | B | 5/1962 |
| DE | 3835296 | A1 | 3/1989 |
| EP | 0222954 | A1 | 5/1987 |
| FR | 794556 | A | 2/1936 |
| FR | 2519045 | A | 7/1983 |
| FR | 2534292 | A1 | 4/1984 |
| GB | 919768 | A | 2/1963 |
| GB | 2060742 | A | 5/1981 |
| JP | 5589527 | A | 7/1980 |
| JP | 5673722 | A | 6/1981 |
| JP | 58185826 | A | 10/1983 |
| JP | 6030713 | A | 2/1985 |
| JP | 60037324 | A | 2/1985 |
| JP | 63223217 | A | 9/1988 |
| JP | 63223218 | A | 9/1988 |
| JP | 1146015 | A | 6/1989 |
| JP | 01260117 | A | 10/1989 |
| NL | 279696 | A | 11/1964 |
| SU | 667636 | A1 | 6/1979 |
| SU | 767285 | A1 | 9/1980 |
| SU | 861476 | A1 | 9/1981 |
| SU | 1033636 | A | 8/1983 |
| WO | 9321393 | A1 | 10/1993 |

OTHER PUBLICATIONS

"Standard Test Method for Piles Under Static Axial Compressive Load"; ASTM D 1143-81; Jan. 1, 1994; pp. 1-11.

* cited by examiner

SEGMENTED FOUNDATION INSTALLATION APPARATUS AND METHOD

This patent application is a continuation-in-part of prior, U.S. patent application Ser. No. 60/331,879, filed Nov. 20, 2001.

BACKGROUND OF THE INVENTION

1. Technical Field

This invention relates to a segmented anchoring and support apparatus utilized as a tool for the installation of finned and non-finned tubular foundations. In one aspect, this invention relates to a method of installation of foundations in the ground utilizing the apparatus of the invention. In one aspect, this invention relates to the utilization of the apparatus and methods of this invention for the installation of SAFE Foundations Secure Anchoring and Foundation Equipment.

2. Background

Tubular foundations are utilized for supporting structures, e.g., lighting poles, across-the-highway traffic signs, communication towers, and others. Tubular foundations are installed in the ground by pressing them into the soil utilizing hydraulic power means and a pre-stressed, conventional anchoring device, which is been anchored, i.e., pre-stressed inside a pre-augered earthen hole.

Conventional tubular foundations are fabricated in a multitude of lengths, requiring the availability of a conventional anchoring device of the proper length for each tubular foundation to be installed, requiring a multitude of conventional, anchoring device lengths. Conventional anchoring devices are pre-stressed inside a pre-augered earthen hole.

The conventional anchoring device, the conventional SAFE Foundation Secure Anchoring and Foundation Equipment, as well as the methods of installation for the conventional anchoring device and for the SAFE Foundation are fully described in U.S. Pat. Nos. 4,843,785 of Jul. 4, 1989, 4,882,891 of Nov. 28, 1989, and 4,974,997 of Dec. 4, 1990.

INTRODUCTION TO THE INVENTION

The installation of a SAFE Foundation requires utilizing an anchoring device of the required length, which depends on the length of the SAFE Foundation. In many instances and occasions, the installation of the SAFE Foundation requires utilizing one, two, or more pairs of additional conventional anchoring devices, which means the installation of a SAFE Foundation sometimes requires three, five, or more conventional anchoring devices instead of a single one.

Conventional anchoring devices are made in one piece, consisting of a one-piece, standard threaded rod with an anchorhead attached at the end of the rod and of a one-piece pipe column, with fins. These conventional anchoring devices have to be transported to the foundation installation site.

One drawback of the conventional anchoring device is they are made only in one-piece full lengths, making them expensive to transport and to handle.

Another drawback is the conventional anchoring device is manufactured only in a limited number of standard lengths, while the SAFE Foundations installed with these devices are manufactured in a multitude of lengths, in increments of six inches. When the installer cannot find a standard anchoring device length, he/she is forced either to install a longer standard length than the actual length required, or the installer is forced to have one special anchoring device made to order, i.e., specially custom ordered of the required size, which means more expensive and time consuming installations.

Yet another drawback is when the installer is forced to utilize a longer-than-required anchoring device. He or she also is forced to drill a deeper earthen hole to accommodate the extra length of the non-standard anchoring device. This translates into additional costs.

Still another drawback exists despite the fact that the characteristics of the soil are known in advance where the SAFE Foundation is to be installed and the length of anchoring device is determined. After augering the earthen hole, unexpected soil conditions are encountered, e.g., an unexpected location of the water table, or reaching an unexpected layer of softer, i.e., weaker soils. In such situations, deeper holes have to be augered, requiring longer anchoring devices, standard or not, to be utilized and therefore not instantly available at the installation site. These unexpected developments create installation delays as well as cost overruns.

A further drawback involves the forces required for stressing the conventional anchoring assembly. At some point during the installation of the anchoring device, force is exerted on the components of the device, instead of being exerted upon the soil, because of its "mechanical stop" that serves as "limiting means." This can provide false readings of the strength of the installation.

Another drawback is the need for large equipment to lift the anchor because of the weight of the long anchor assembly.

Yet a further drawback is that the conventional anchoring device is very difficult to retrieve from inside its earthen hole, if after the installation is complete its top portion falls below grade, i.e., below the top surface of the earthen hole it was installed in.

According, there is a need for apparatus and method for installing a SAFE Foundation which is less expensive and much easier to handle while providing any length required.

It is therefore an object of the present invention to provide apparatus and method for installing a SAFE Foundation which is less expensive and much easier to handle while providing any length required.

It is another object of the present invention to provide apparatus and method for installing a SAFE Foundation that can be readily available in the field and easy to assemble in the field to match any required length, eliminating the need to install special lengths.

It is yet another object of the present invention to provide apparatus and methods for installing a SAFE Foundation that eliminate the need to drill a deeper earthen hole, when the installer is forced to use a longer anchoring device, by providing the installer with apparatus and methods to match any length required by the foundation to be installed with it.

It is still another object of the present invention to provide apparatus and methods for installing a SAFE Foundation that can meet any unforeseen length requirement because of unexpected soil conditions.

It is a further object of the present invention to provide apparatus and methods for installing a SAFE Foundation which always exerts the installation forces upon the soil instead of exerting the forces upon its components.

It is yet a further object of the present invention to provide apparatus and methods for installing a SAFE Foundation which is easily retrievable, even when its top portion falls down below the surface, at the top of the earthen hole it was installed in.

These and other objects of the present invention will become apparent to those skilled in the art from a careful review of the detailed description which follows.

SUMMARY OF THE INVENTION

The apparatus and method of the present invention provide for installation of a novel segmented foundation and anchoring device of any required length. The installation of the novel segmented foundation uses an anchoring device manufactured in a multitude of lengths, e.g., in one aspect in increments of six inches. The apparatus and method of the present invention provide for installing a segmented foundation which is less expensive and much easier to handle while providing any length required. The apparatus and method of the present invention provide for installing a segmented foundation that can be readily available in the field and easy to assemble in the field to match any required length, eliminating the need to install special lengths. The novel segmented foundation and anchoring device eliminate the need to drill a deeper earthen hole, when the installer is forced to use a longer anchoring device, by providing the installer with apparatus and methods to match any length required by the foundation to be installed with it, and meet any unforeseen length requirement because of unexpected soil conditions. The apparatus and method of the present invention provide for installing a novel segmented foundation and anchoring device which always exert the installation forces upon the soil instead of exerting the forces upon its components, and which are easily retrievable, even when the top portion falls down below the surface, at the top of the earthen hole it was installed in.

The apparatus and method of the present invention provide for a segmented anchoring or foundation apparatus to be installed in an earthen hole, including a vertical segmented support means and a plurality of spaced media consolidation plates swingably mounted about respective pivot points on the vertical support means, the plates having media-facing surfaces swingable outwardly from the vertical support means into the surrounding media. Varying segmented lengths form the segmented vertical support means. In one aspect, the apparatus and method of the present invention provide for a centering collar 113, an anchor positioning means at level force pivoting plates 194, and pivoting plates 194 are positioned 40-50 degrees from vertical. In one aspect, the pivoting plates 194 positioned 45 degrees from vertical. In one aspect, the apparatus and method of the present invention provide for a frusto-cone 197 having a dx equal to a predetermined distance of one-half inch to form gap 204. The method for installing an anchor for a foundation device in the earth includes preparing a hole in the earth, lowering into the hole a segmented anchor or foundation device having swingable media facing plates, and applying force to swing the plates outwardly into the surrounding media.

The apparatus and method of the present invention include providing a central segmented rod means; plate assembly means mounted around the rod means; pipe column means around the central segmented rod means positioned above the plate assembly means; a plurality of circumferentially spaced media consolidation plates the plate assembly means; swing means on the media facing surfaces pivotally mounted and swingable outwardly about respective pivot points in a substantially vertical arc; spreader means adapted to swing the plates outwardly into the surrounding media upon relative vertical movement between the pipe column means and the rod means to spread the plates to an arc of no more than about 55 degrees; restrainer means to restrain the plate assembly means from vertical movement; and force applying means adapted to provide relative vertical movement between the pipe column means and the rod means.

BRIEF DESCRIPTION OF THE DRAWINGS

FIG. 3 also shows a centering collar, a hydraulic cylinder assembly, and component parts of the present invention.

FIG. **4*a*** is an elevation view of a Dywidag coupling, component part of the present invention.

Figure 5:
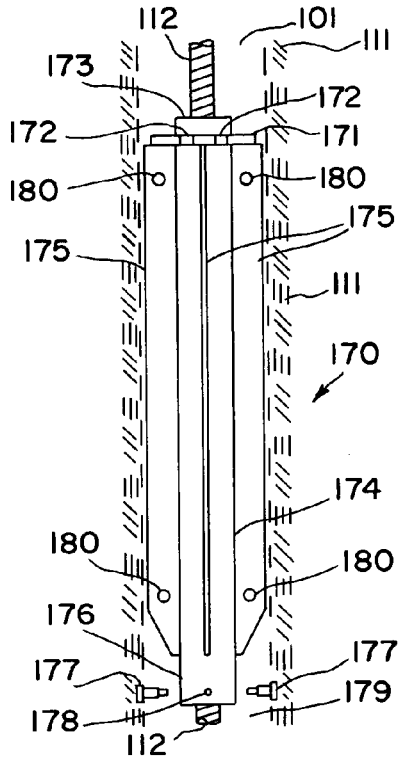

FIG. 5 is an elevation view of the bottom segment component part of a preferred embodiment of the present invention.

Figure 6:
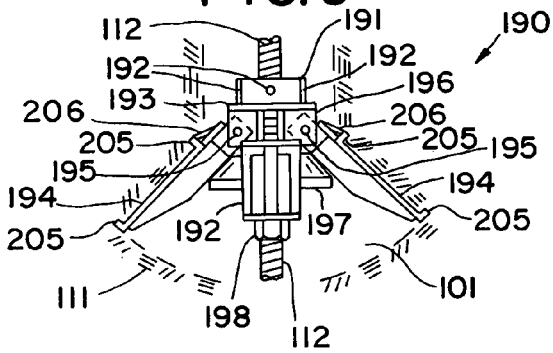

FIG. 6 is an elevation view of the anchoring head assembly component part of a preferred embodiment of the present invention.

FIG. **6*a* is a detail view showing in elevation and partially in section the frusto-cone of FIG. 6**, restrained inbetween two nuts.

Figure 3:
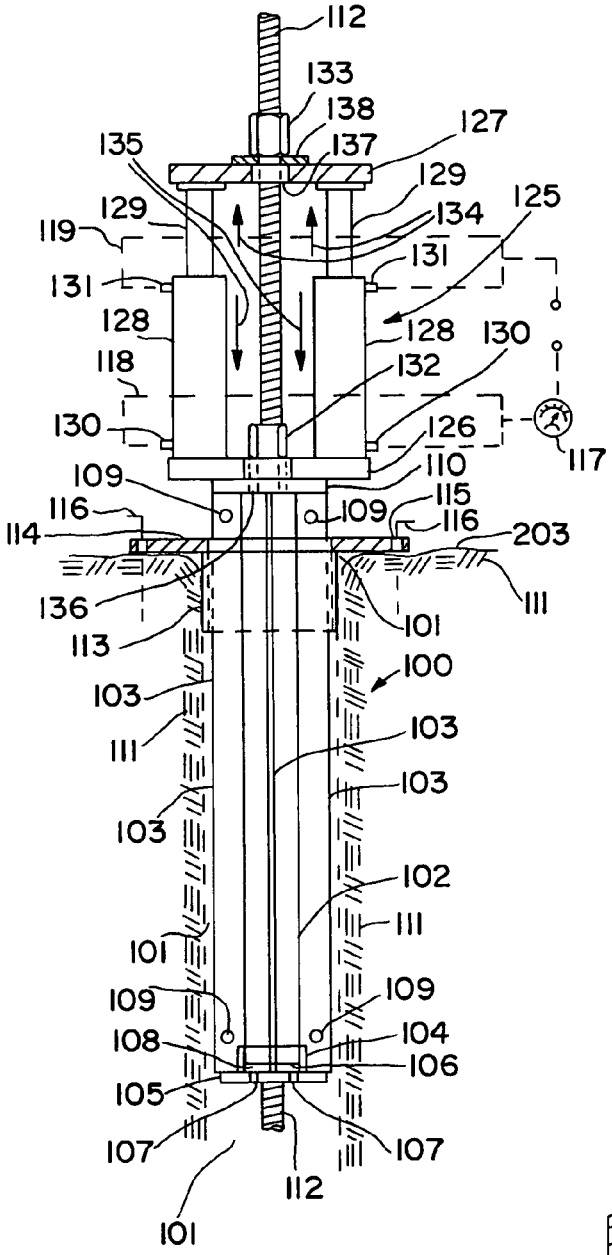
FIG. 3 is an elevation view of the top segment component part of the preferred embodiment of the segmented foundation-anchoring and support assembly of the present invention.
Figure 7:
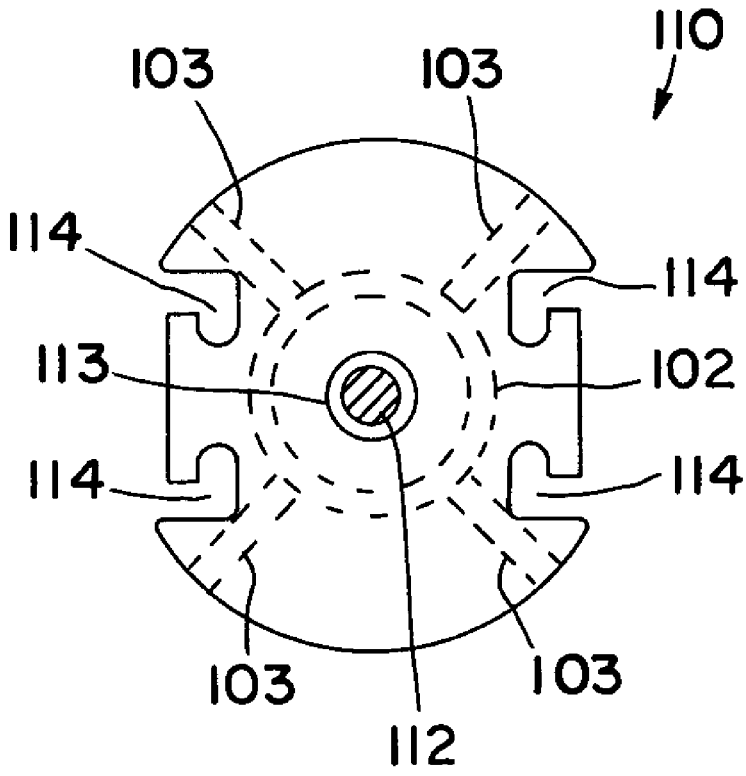

FIG. 7 is a top plan view of the top plate of FIG. 3.

Figure 8:
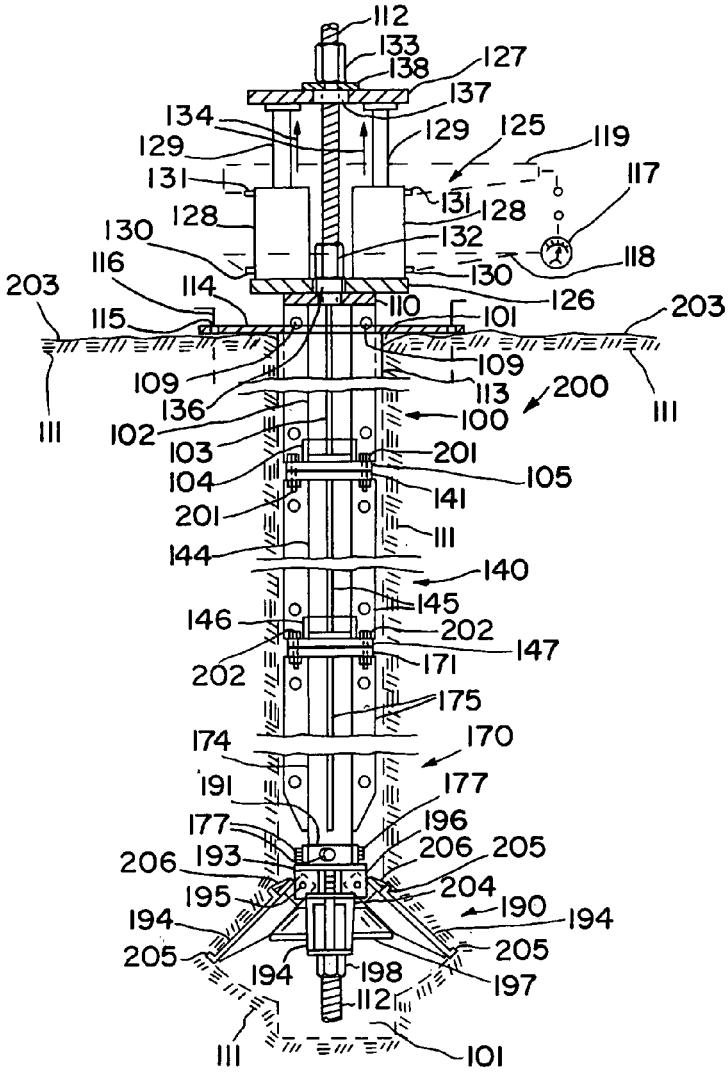

FIG. 8 is an elevation view of the segmented, foundation anchoring and support assembly of a preferred embodiment of the present invention, fully assembled and installed in an earthen hole. FIG. 8 also shows a centering collar and a hydraulic cylinder assembly.

Figure 9:
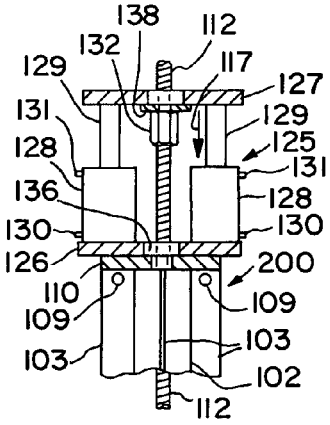

FIG. 9 is an elevation view of the hydraulic cylinder assembly of the present invention, showing a reversed movement of its pistons, by the methods of the invention.

Figure 10:
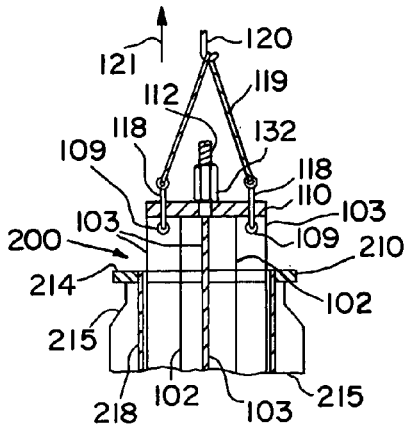

FIG. 10 is an elevation view partially showing the segmented anchoring and support assembly of the present invention being lifted, by the method of the invention.

Figure 11:
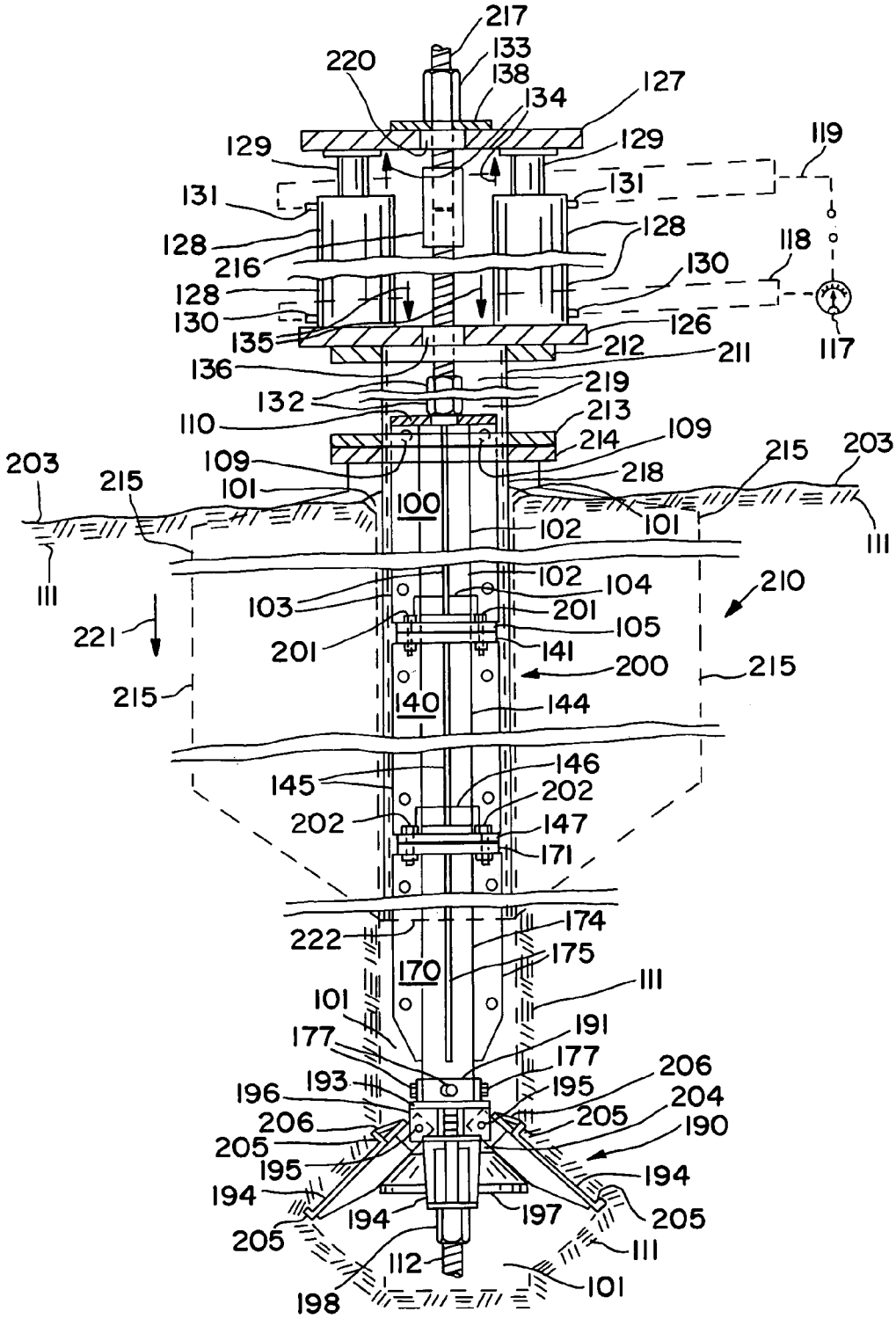

FIG. 11 is an elevation view of the segmented foundation anchoring and support assembly of the present invention, in the process of installing a SAFE Foundation.

Figure 12:
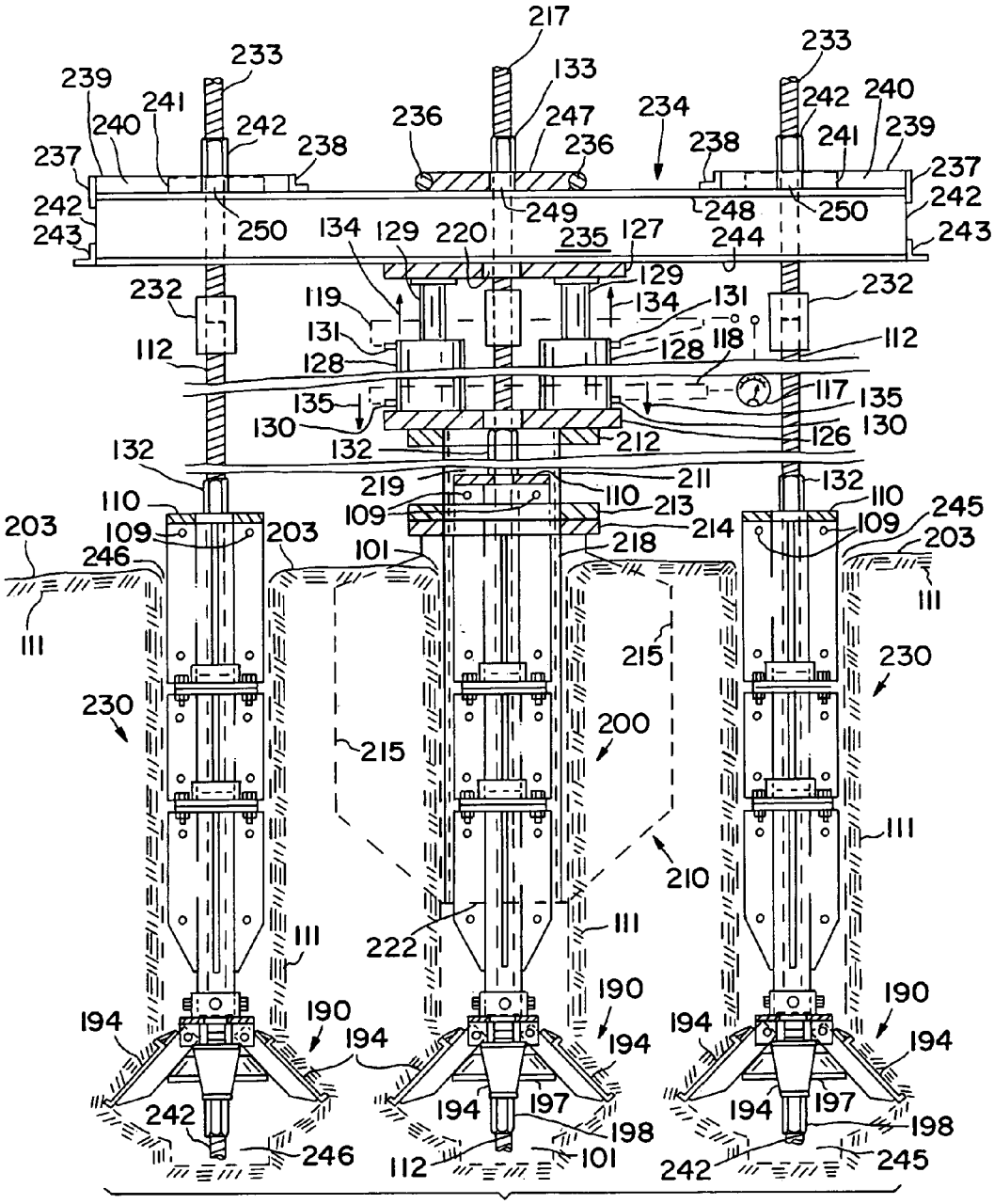

FIG. 12 is an elevation view showing one segmented foundation anchoring and support assembly and two satellite segmented foundation anchoring and support assemblies. FIG. 12 also shows a pushing collar, a hydraulic cylinder assembly, and a beam assembly, in combination to form all component parts of the present invention, shown in the process of installing a SAFE Foundation.

DETAILED DESCRIPTION

Figure 1:
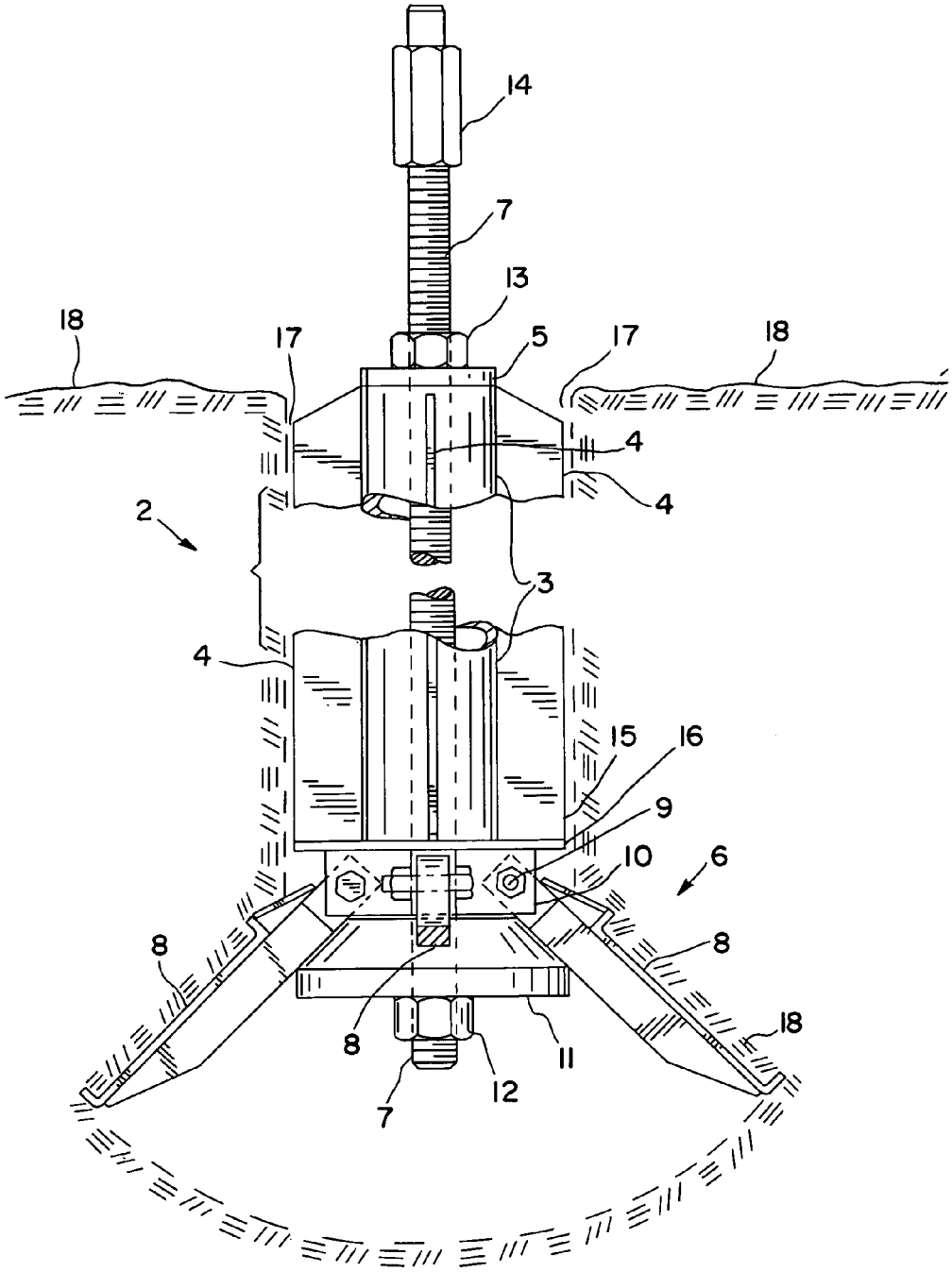
FIG. 1 PRIOR ART
FIG. 1 is an elevation view, partially cut-away, of anchoring and foundation support apparatus.

FIG. 1 shows a foundation anchoring and support assembly 2 utilized for the installation of a SAFE Foundation in the ground. FIG. 1 shows a one-piece foundation-guiding column 2, shown cut-away in order to show one-piece, standard threaded rod 7 going through the inside of a one-piece pipe column 3. Anchoring assembly 2 is shown already installed, inside earthen hole 17, in soil 18.

Foundation-guiding column 2 includes a one-piece length of steel pipe 3, with three or four fins 4 welded along vertical surface 3 and at ninety degrees from each other. A top plate 5 is welded to the top end of pipe 3.

FIG. 1 also shows an anchoring head assembly 6, including one-piece threaded rod 7, four pivoting compaction and consolidation plates 8 (only two are fully shown and one is partially shown) which pivot around bolts 9, also support frame 10 with plate 16 welded to it, frusto-cone 11 held in position by nut 12, which is threaded-on to the bottom end of threaded rod 7.

By pulling threaded rod 7 upwardly, nut 12 pulls frusto-cone 11 also upwardly. This in turn forces the four pivoting compaction and consolidation plates (only two fully shown) and swing upwardly around bolts 9 and away from their original vertical position. Nut 13 and nut 14 are utilized at various stages of the installation process. Bottom end 15 of foundation-guiding column 2 rests on plate 16 of support frame 10 of anchoring head assembly 6.

Figure 2:
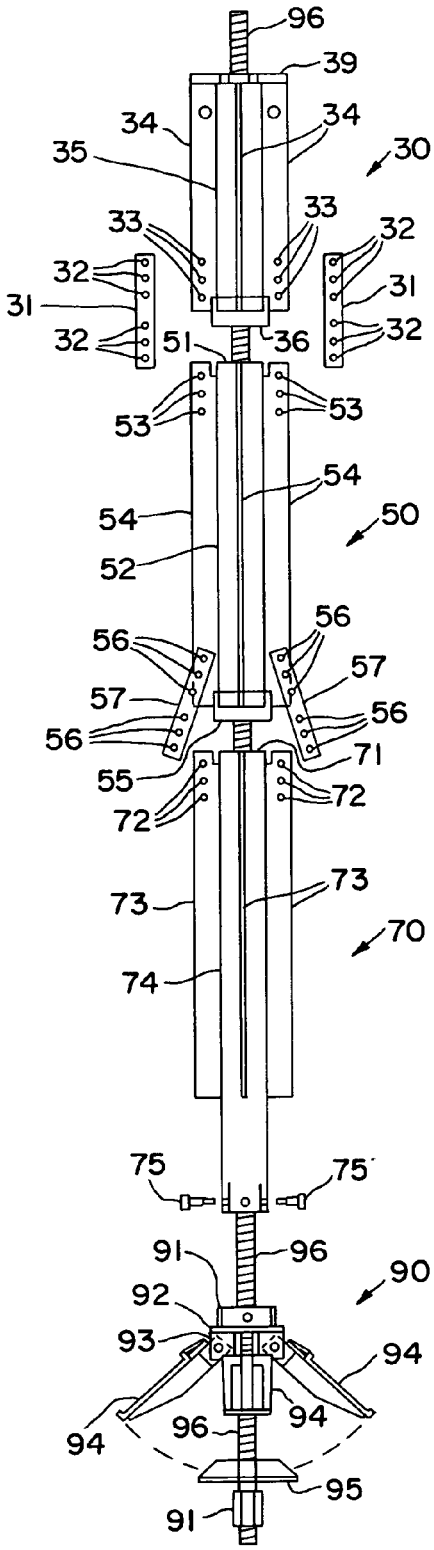
FIG. 2 is an elevation view of one embodiment of the segmented foundation anchoring and support assembly of the present invention.

Referring now to FIG. 2, one embodiment of the segmented foundation anchoring and support assembly of the present invention is shown partially assembled, in order to enable a better understanding of its component parts.

Novel segmented foundation-anchoring and support assembly of FIG. 2 includes top segment 30, middle segment 50, bottom segment 70, and anchoring head assembly 90.

Top segment 30 has four fins 34 (only three are shown) vertically welded to pipe 35. Sleeve 36 is welded to the bottom end of pipe 35 of top segment 30, and it is utilized for helping align the top end 51 of pipe 52 of middle segment 50 to top segment 30. Top plate 39 is welded to pipe 35 and fins 34. Flat bar 31 is utilized for firmly bolting top segment 30 to middle segment 50, by means of four bolts (not shown) with their respective nuts (not shown) on each bar, through bolt holes 32 on flat bars 31 and bolt holes 33 on fins 34 and through bolt holes 53 on fins 54 of middle section 50. Flat bars 31 could be welded instead to fins 34 and bolted on to fins 54.

There are two flat bars 31 including one on the front and one on the back (not shown) of each fin 34 of top segment 30 and fins 54 of middle segment 50.

Middle segment 50 also has four fins 54 (only three are shown) vertically welded to pipe 52. Sleeve 55 is welded to the bottom end of pipe 52 of middle segment 50 and is utilized in attaching top end 71 of pipe 74 of bottom segment 70 to middle segment 50. Flat bars 57 are utilized for firmly bolting middle segment 50 to bottom segment 70 by means of four screws (not shown) with their respective nuts (not shown), through bolt holes 56 on flat bars 57 and bolt holes (not shown) on fins 54 of middle segment 50 and through bolt holes 72 on fins 73 of bottom segment 70. There are two flat bars 57, one on the front and one on the back (not shown) of each fin 54 of middle segment 50 and fins 73 of bottom section 70. Flat bars 57, instead, could be welded to fins 54 while bolted to fins 73.

Bottom segment 70 also has four fins 73 (only three are shown), vertically welded to pipe 74. Bottom segment 70 attaches to anchoring head assembly 90 by means of collar 91 on anchoring head assembly 90 and four screws 75 (only two are shown).

Anchoring head assembly 90 has collar 91 welded to steel plate 92, which in turn is welded to the top side of structural support frame 93. Frame 93 includes four ninety-degree angled bars 93 (only two shown) which provide support to four pivoting compaction and consolidation plates 94 (only three are shown). Frusto-cone 95 is held in position by nut 94, which is threaded-on to the bottom of threaded rod 96. Threaded rod 96 goes through the inside of segments 30, 50, and 70. Rod 96 can be segmented, i.e., made of several length of rod joined together by means of a threaded coupling, not shown.

The completely assembled-segmented foundation-anchoring and support of FIG. 2 is inserted, i.e., lowered vertically down in a pre-augered earthen hole (not shown).

FIGS. 3 through 12 represent the preferred embodiment of the segmented foundation-anchoring and support assembly of the present invention.

Referring now to FIG. 3, top segment 100 and hydraulic cylinder assembly 125 are shown in the installation mode, i.e., pushing mode.

Top segment 100 is shown inside pre-augered earthen hole 101, in soil 111, and passing through centering collar 113, which is at the top of earthen hole 101 and inside it, with its top plate 113 firmly resting on the top of surface 203. Top plate 114 of centering collar 113 has four through holes 115, utilized for driving pins 116 through them into soil 111, in order to keep centering collar 113 centered at the top of earthen hole 101.

Top segment 100 includes steel pipe column 102, to which four vertical fins 103 (only three are shown) are welded at ninety degrees to each other and parallel to the vertical axis of pipe column 102. Steel collar 104, welded to flange 105, also is welded to the bottom of fins 103, with end 106 of pipe column 102 protruding approximately half-way inside of collar 104. Flange 105 is utilized for bolting on to top flange 141, FIG. 4 of middle segment 140, by means of bolts 201 as shown in FIG. 8, through bolt holes 107, FIG. 3 and bolt holes 142 of FIG. 4, on flanges 105 and 141, respectively.

Figure 4:
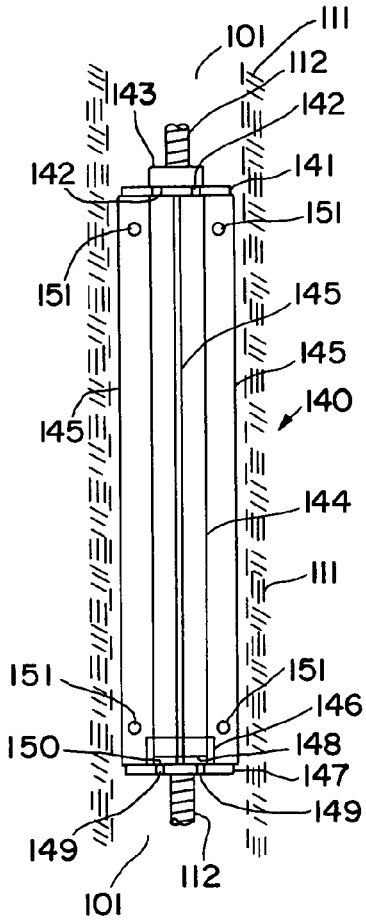
FIG. 4 is an elevation view of the middle segment component part of the preferred embodiment of the present invention.

Top end 143 of pipe column 144, of middle segment 140 of FIG. 4, protrudes inside collar 104 of top segment 100 of FIG. 3 and firmly abutts against bottom end 106 of pipe column 102 of top segment 100. Flanges 105, 141 are bolted together, therefore closing up space 108 of FIG. 3, as shown in FIG. 8.

Steel fin 103, FIG. 3, each has two holes 109 at the top end and another two at the bottom end. Holes 109 are utilized for helping in hoisting 100, when necessary.

Top plate 110 is welded at the top-end of top segment 100, both to the pipe column 102, as well as, to fins 103. Top plate 110 is utilized for setting hydraulic cylinder assembly 125, a component part of the present invention, on top of the segmented foundation-anchoring and support assembly, shown fully assembled on FIG. 8. Hydraulic cylinders assembly 125 is utilized, first to anchor the segmented foundation-anchoring and support assembly to the bottom of earthen hole 101, as shown in FIGS. 6 and 8, and second for pushing a SAFE Foundation in soil 111 as shown in FIG. 11, utilizing the segmented foundation-anchoring and support assembly as a vertically guiding column, inside pre-augered, vertical earthen hole 101, as well as an anchor point to push against in order to push a SAFE Foundation downwardly into soil 111 in a vertical direction as shown in FIG. 11.

Top segments 100 of FIG. 3 can be fabricated in a variety of lengths, preferably in four feet lengths.

Continuing to refer to FIG. 3, threaded rod 112, preferably a "Dywidag" rod manufactured by Dywidag Systems International of Fairfield, N.J., is shown passing through the inside of top segment 100, through its bottom flange 105, through its top plate 110, through bottom plate 126 of hydraulic assembly 125, through top plate 127 of hydraulic assembly 125, and through washer plate 138.

"Dywidag" nut 132 is utilized to hold anchor head 190 of FIG. 6, anchored against soil 111 at the bottom of earthen hole 101, preventing it from falling down. "Dywidag" nut 133 is utilized for providing a point of resistance for pistons 129 of hydraulic cylinder assembly 125 to push against both nuts 132, 133 are treaded on Dywidag rod 112.

Hydraulic cylinder assembly 125 is a component part of the present invention. Hydraulic assembly 125 includes two hydraulic cylinders 128 with their respective pistons 129, a pump (not shown), hydraulic hoses 118, 119, pressure gauge 117, and controls (not shown). The bottoms of cylinders 128 are welded to bottom plate 126, while the top ends of pistons 129 are welded to top plate 127.

Hydraulic cylinders assembly 125 is operated by means of a hydraulic pump (not shown) of the required capacity. Hydraulic fluid inlets 130 and outlets 131 allow pumped hydraulic fluid into and out of cylinders 128 via hoses 118, 119 in the process of forcing pistons 129 out of and back into their respective cylinders 128. The relative movements of pistons 129 and cylinders 128 are represented, respectively, by arrows 134, 135.

Hydraulic cylinder assembly 125 provides the powerful force required to anchor the segmented foundation anchoring and support assembly 200 in soil 111 as shown in FIG. 8. They also provide the powerful force required for installing, i.e., for pushing, a tubular foundation, e.g., finned tube SAFE Foundation 210, into soil 111 as shown in FIGS. 11 and 12.

Referring now to FIG. 4, middle segment 140, a component part of the present invention, includes steel pipe column 144, to which four vertical fins 145 (only three are shown) are welded at ninety degrees to each other and parallel to the vertical axis of pipe column 144. Steel collar 146, welded to flange 147, also is welded to the bottom of fins 145, with bottom end 148 of pipe column 144 protruding approximately half-way inside of collar 146. Flange 147 is utilized for bolting onto top flange 171, FIG. 5, of bottom segment 170 by means of bolts 202 as shown in FIG. 8, through bolt holes 149 on flange 147 of FIG. 4 and bolt holes 172 of flange 171 of FIG. 5.

Top end 173 of pipe column 174 of bottom segment 170 of FIG. 5, protrudes inside collar 146 of middle segment 140 of FIG. 4 and firmly abutts against bottom end 148 of pipe column 144, when flanges 147, 171 are bolted together, therefore closing up space 150, as shown in FIG. 8.

Fins 145, each having two holes 151 at the top and another two at the bottom, includes holes 151 for aiding in hoisting middle segment 140 when required.

"Dywidag" rod 112 is shown passing through the inside of middle segment 140, through its bottom flange 147, and through its top flange 141.

Middle segments 140 can be fabricated in a variety of lengths, preferably in one, two, and three feet lengths.

Figure 4A:
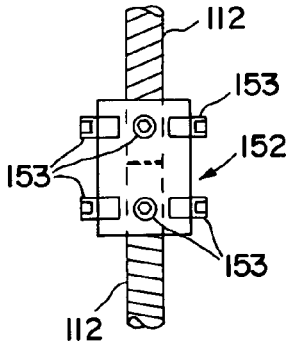

Referring now to FIG. 4*a*, the present invention provides the capability of utilizing a segmented "Dywidag" rod, by joining together two lengths of "Dywidag" rod by means of an inside threaded "Dywidag" coupling 152, creating a very strong joint. The strength of the joint substantially is increased by eight Allen set-screws 153 (only six are shown).

The segmenting of rod 112 eliminates the need to transport very long pieces of "Dywidag" rod. These rod segments are assembled easily as shown in FIG. 4*a*, by threading "Dywidag" rod 112 pieces into inside-threaded coupling 152 and then threading-in and tightening eight Allen-set-screws (only six are shown). These joints fit inside pipe column 144 or any other of the pipe columns.

Referring now to FIG. 5, bottom segment 170, a component part of the present invention includes steel pipe column 174 to which four vertical fins 175 (only three are shown) are welded at ninety degrees to each other and parallel to the vertical axis of pipe column 174. Four bolts 177 (only two are shown) are utilized for bolting end 176 of pipe column 174 onto collar 191 of anchor head assembly 190 of FIG. 6, through four threaded holes 178 (only three are shown) on end 176 of pipe column 174 and through four holes 192 (only three are shown) on collar 191 of anchor head assembly 190 of FIG. 6.

End 176 of pipe column 174 is to be inserted into collar 191 until its bottom end 179 firmly rests on top of plate 193 of FIG. 6. Then bolts 177 are threaded-in and tightened. Bottom end 176 of pipe column 174 are made to fit either inside or outside of collar 191 of FIG. 6.

Fins 175 of bottom segment 170 are cut at an angle toward end 176 of pipe column 174, in order to facilitate the insertion of end 176 inside collar 191 and also to facilitate the bolting of the two components, i.e., pipe column 174 and anchoring head 190.

"Dywidag" rod 112 is shown passing through the inside of bottom segment 170, inside pipe column 174, and through flange 171.

Bottom segments 170 are fabricated in a variety of lengths, preferably in four feet lengths.

Figure 6A:
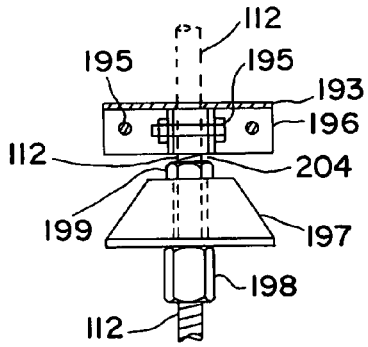

Referring now to FIG. 6, anchoring head assembly 190 includes threaded rod 112, preferably a "Dywidag" threaded rod, which are made of several pieces, joined by "Dywidag" couplings, FIG. 6*a*, also including four pivoting, compaction and consolidation plates 194 (only three are shown), which pivot, i.e., swing upwardly, around bolts 195 and in-between two steel plates 196, which are component parts of plate support frame 196. Each plate has rib means 205 and incline ramps 206. Anchoring head assembly 190 also has frusto-cone 197 at the bottom end of "Dywidag" rod 112, held in place by "Dywidag" nut 198, which is threaded on the bottom end of "Dywidag" rod 112 and by a shorter Dywidag nut 199, detail FIG. 6*a*.

By pulling "Dywidag" rod 112 upwardly, Dywidag nut 198 pulls frusto-cone 197 also upwardly. This, in turn, forces the four pivoting, compaction and consolidation plates 194 (only three are shown) to pivot, i.e., to swing upwardly, around bolts 195 and away from their original vertical position at the bottom of earthen hole 101, as shown in FIG. 6. By pushing "Dywidag" rod 112 downwardly, frusto-cone 197 also is pushed downwardly because of shorter "Dywidag" nut 199 of FIG. 6*a*.

When the anchoring and support assembly of the present invention is fully assembled, a sufficiently powerful force is exerted on "Dywidag" rod 112 while it is being pulled upwardly, pivoting compaction and consolidation plates 194 to press, i.e., push and compact, soil 111 at the bottom of earthen hole 101, as shown in FIGS. 6 and 8, firmly anchoring pivoting plates 194, as also shown in FIGS. 6 and 8. Pivoting compaction and consolidating plates 194 are swung out and upwardly, into soil 111 up to a desired point, to a point where pivoting plates 194 are at an angle of approximately forty-five degrees from their original vertical position. Pivoting plates 194 then are kept from falling back down, by means of nut 132 of FIGS. 3, 8, which is threaded downwardly on "Dywidag" rod 112, and hand tightened against top plate 110, FIG. 3, before releasing the force that swung plates 194 upwardly.

FIG. 6*a* is a detail of a portion of the anchoring head assembly 190 of FIG. 6 with pivoting plates 194 removed, in order to show how frusto-cone 197 is restrained in between a full-size "Dywidag" nut 198 on its bottom and a shorter "Dywidag" nut 199 on its top. Both "Dywidag" nuts 198, 199 are threaded on "Dywidag" rod 112, which is shown in FIG. 6*a* passing through frusto-cone 197 and support frame 196 and plate 193 with a gap 204 of about one half of one inch between the top of "Dywidag" nut 199 and the bottom of support frame 196.

FIG. 7 shows a plain view detail of top plate 110 of top segment 100 of FIG. 3. Fins 103 are welded to the underside of top plate 110 and to pipe column 102. Top plate 110 has a center hole 113 in order to allow "Dywidag" rod 112 pass through it. Wire rope choker-openings 114 are utilized for engaging a wire rope choker, as shown in FIG. 6*a*, in the process of lowering down or pulling out of earthen hole 101 the foundation-anchoring and support assembly 200, shown fully assembled in FIG. 8. The foundation-anchoring and support assembly of the present invention is reusable. In other words, after it has been utilized for installing a SAFE Foundation, it is retrieved, i.e., pulled up and out of earthen hole 101 to be reused again, many times more.

FIG. 8 shows the foundation-anchoring and support assembly 200 of the present invention fully assembled and anchored inside pre-augered earthen hole 101 by means of its anchoring head assembly 190. "Dywidag" nut 132 is shown threaded on "Dywidag" rod 112 and tightened against top plate 110.

Top segment 100 is bolted onto middle segment 140 by means of bolts 201 and collar 104, flange 105 of top segment 100, and flange 141 of middle segment 140.

Middle segment 140 is bolted onto bottom segment 170 by means of bolts 202 and collar 146, flange 147 of middle segment 140, and flange 171 of bottom segment 170.

Bottom segment 170 is bolted onto anchoring head assembly 190 by means of bolts 177 bolted onto collar 191 of anchoring head assembly 190 by means of bolts 177. Collar 191 is welded to plate 193 which, in turn, is welded to the top end of plate support frame 196. Four pivoting plates 194 (only three shown) pivot around bolts 195 in frame 196, when pushed up by frusto-cone 197.

Centering collar 113 is shown inside and at the top of earthen hole 101 with plate 114 welded to collar 113 and resting on surface 203 of soil 111. Four pins 116 (only two are shown) are inserted through holes 115 of plate 114 of centering collar 113 with the purpose of firmly keeping centering collar 113 vertically aligned inside hole 101.

Centering collar 113 is utilized for keeping the anchoring assembly of the present invention in a vertical position inside hole 101 and for preventing the anchoring assembly 200 from moving sideways during the anchoring process.

A problem constantly encountered during installations utilizing the prior art anchoring assembly empirically has been found to be resolved after many trials and errors, by installing the proper centering collar 113 component of the present invention.

FIG. 8 also shows a hydraulic cylinder assembly 125, with hydraulic fluid-carrying hoses 118, 119 and pressure gauge 117, all component parts of the present invention. Hydraulic cylinder assembly 125 is shown with its bottom plate 126 set on top of plate 110 and with its pistons 129 extended out of their respective cylinders 128. Arrows 134 show the upward movement of pistons 129 as they extend out of their respective cylinders 128.

"Dywidag" threaded rod 112 passes through the inside of the entire assembly, and it has "Dywidag" nut 132, threaded onto it and hand tightened against plate 110, in order to prevent pivoting plates 194 from falling back down from their anchored position after hydraulic assembly 125 is removed.

Steel plate washer 138 is shown on top of top plate 127 of hydraulic cylinder assembly 125. "Dywidag" nut 133 is shown threaded down on "Dywidag" rod 112 and tightened against steel plate washer 138. After the foundation-anchoring and support assembly has been anchored inside earthen hole 101, nut 133 and plate washer 138 are removed, in order to allow the removal of hydraulic cylinder assembly 125, while "Dywidag" nut 132 remains tightened against plate 110, maintaining anchoring assembly 200 anchored in place. FIG. 8 also shows frusto-cone 197 held in place at the bottom end of "Dywidag" rod 112 by means of "Dywidag" nut 198 which is threaded-up at the bottom of "Dywidag" rod 112.

FIG. 9 shows the top end of the segmented anchoring and support assembly, with hydraulic cylinder assembly 125 on top of plate 110 of the anchoring assembly 200. Hydraulic fluid-carrying hoses 118, 119 and pressure gauge 117, as shown in FIG. 8, are not shown in this detail view, for simplification purposes only. In this view of hydraulic assembly 125, "Dywidag" nut 132 has been threaded up from its original position, (as shown in FIG. 8), where it was hand-tightened against plate 110 through hole 136 of plate 126 of hydraulic assembly 125. Plate washer is shown now also removed from its original position, as also shown in FIG. 8, where it was placed on top of plate 127 and now is underneath plate 127 of hydraulic assembly 125, with "Dywidag" nut 138 now hand-tightened against plate washer 138. Arrow 117 shows the downwardly push of pistons 129, against threaded nut 132, which is threaded on rod 112.

FIG. 10 shows the segmented anchoring and support assembly 200, partially depicted, in the process of being lifted by hook 120 of a crane (not shown) attached to a wire-rope choker 119 with two heavy duty devises 118 bolted through holes 109 on fins 103. Segmented anchoring and support assembly 200 is shown being lifted through the inside of pipe column 218 of SAFE Foundation 215.

FIG. 11 shows the anchoring assembly of the present invention in the process of installing SAFE Foundation 210 in soil 111.

The anchoring and support assembly 200 is shown inside pipe column 218 of foundation 210. Bottom 222 of pipe column 218 of foundation 210 is shown at about one and one half feet from the top of collar 191.

For the purpose of this description, foundation 210 will be considered completely installed when the bottom of its top plate 214 is sitting on surface 203 of soil 111. Accordingly, foundation 210 of FIG. 11 is shown partially installed. Nevertheless, top plate 214 of foundation 210 can be installed at any elevation required. By way of an example, top plate 214 of foundation 210 can be installed at six inches above surface 203 of soil 111 if the structure to be mounted upon foundation 210 so requires.

Foundation 210 has four fins 215 (only two shown) vertically welded to its pipe column 218 and to the bottom of its top plate 214. Fins 215 are at ninety degrees from each other. If foundation 210 is a three-fin foundation, then fins 215 would be at one hundred and twenty degrees from each other, instead. Foundation 210 also could be without fins 215, if so specified.

Pushing collar 211 has its bottom flange 213 on top of flange 214 of foundation 210. Bottom plate 126 of hydraulic assembly 125 sits on top of top plate 212 of pushing collar 211. The top end of anchoring assembly 200 is shown partially inside 219 of pushing collar 211. Pushing collar 211 is utilized to provide a safety space between bottom end 222 of foundation 210 and pivoting plates 194 and also between the top end of the anchoring assembly 200 and the bottom plate 126 of hydraulic assembly 125. Such a safety space is necessary because occasionally the anchoring assembly of the present invention could be pulled up, when soil 111 at the bottom of earthen hole 101 does not provide enough resistance. In such cases, it is required to install additional segmented foundation-anchoring and support assemblies as shown in FIG. 12. It has been found that these additional anchoring assembly "satellite anchors" are to be installed in pairs of satellite anchors 230, as shown in FIG. 12.

Continuing to refer to FIG. 11, "Dywidag" coupling 216 has been utilized for extending the length of "Dywidag" rod 112 with an additional length of "Dywidag" 217. A "Dywidag" coupling 152, with its Allen set-screws 153, as shown in FIG. 4*a*, is utilized instead when installing large size foundations requiring large forces.

Hydraulic cylinder assembly 125 is shown on top of plate 212 of pushing collar 211 and with steel plate washer 138 and "Dywidag" nut 133 firmly tightened against it, by threading nut 133 down on "Dywidag" extended rod 217.

Arrows 134 represent the upward push of pistons 129 of hydraulic assembly 125 against "Dywidag" nut 133. Since the pushing force of pistons 129 can not move nut 133 and "Dywidag" rod 112, because the anchoring head assembly 190 previously has been anchored firmly at the bottom of earthen hole 101, cylinders 128 are the ones that move downwardly instead, as represented by arrows 135, effectively transferring the downward push onto foundation 210, pressing it into the ground, i.e., into soil 111, as represented by arrow 221.

Referring now to FIG. 12, the foundation-anchoring and support assembly of the present invention is shown in the process of installing SAFE Foundation 210, by pushing it into soil 111. The installation of SAFE Foundation 210 is shown taking place with the help of a pair of additional, i.e., satellite, segmented anchoring and supports assemblies 230. Satellite anchoring and support assemblies 230 substantially are identical to center anchoring and support assembly 200 of FIG. 8.

Segmented satellite anchoring and support assemblies 230 are required when soil 111 does not provide enough resistance at the bottom of earthen hole 101 to the force required to push SAFE Foundation 210 into soil 111. In such cases, the force exerted by hydraulic cylinder assembly 125 is spread among one, two, or more pairs of satellite anchors 230.

Segmented satellite anchoring assemblies 230 also are required when the force needed to push foundation 210 exceeds the allowable force for one single foundation anchoring and support assembly 200. The allowable force for one anchoring assembly is approximately eighty tons. By utilizing one or more pairs of segmented satellite anchoring assemblies 230, in addition to the center anchor, i.e., anchoring assembly 200, the total force is spread among all the anchoring assemblies.

The requirement for satellite anchors 230 depends on the size of foundation 210 to be installed. Soil characteristics are determined in advance, and the foundation is fabricated before it is installed.

FIG. 12 shows center anchoring assembly 200 and two satellite anchoring assemblies 230 already installed, i.e., anchored, inside earthen holes 101, 245, 246, respectively.

Foundation 210 is shown partially installed, i.e., partially pressed into soil 111. A small portion of foundation 210 is shown still above surface 203 of soil 111.

The top end of center anchoring assembly 200 is shown partially inside space 219 of pushing collar 211. Hydraulic cylinders assembly 125 is shown on top of top plate 212 of pushing collar 211.

I-Beam assembly 234 is shown on top of top plate 127 of hydraulic assembly 125. "Dywidag" rods 112 of each anchoring assembly have been extended in length by means of "Dywidag" couplings 216, 232 and a length 217, 233 of "Dywidag" rod, respectively.

I-Beam assembly 234 includes two parallel I-Beams 235 (only one shown) providing a space (not shown) in between the two, parallel, I-Beams 235 (only one is shown).

I-Beams 235 have angle channels 243 welded across the ends of beam flanges 244 and to webs 242 on both I-Beams at each end 242 of beams 235. Plates 237 are welded across the ends of beam flanges 248 and to webs 242 of I-Beams 235 at each end. I-Beams 235 have one sliding plate 241 on each end, across the top of beam flanges 248 (only one is shown). Each sliding plate sits across the top of the two I-Beams 235. Sliding plates 241 are moved inside respective box 240 on the top ends of I-Beams 235. Boxes 240 are formed by plates 237, 239, angle bars 238, and the top of beam flanges 248. Plates 237, 239 and angle bars 238 all are welded to and across the top of beam flanges 248 (only one shown). Extended rods 233 pass through and in-between I-Beams 235 and through a center hole 250 on plates 241. "Dywidag" nuts 242 are threaded down extended rods 233 and tightened firmly against plates 241.

Plate 247 is welded at 236 to and across the topside of flanges 248 (only one shown) of I-Beams 235 (only one shown). Extended rod 217 passes in-between I-Beams 235 and through a center hole 249 on plate 247. "Dywidag" nut 133 is threaded down on extended rod 217 and firmly tightened against plate 247.

Hole 220 on top plate 127 of hydraulic cylinders assembly 125 is sufficiently large to allow "Dywidag" coupling 216 easily pass through it.

Arrows 134 represent the upward push of pistons 129, pushing against beam assembly 234. Beam assembly 234 can not move because of anchoring and support assemblies 200, 230, which are all anchored at the bottom of holes 101, 245, 246, respectively. Cylinders 128 move, i.e., push, downwardly as represented by arrows 135. The downward push, presses, i.e., injects foundation 210 into soil 111.

Installation Methods

Method of Installation of the Anchoring and Support Assembly of this Invention

Referring to FIG. 8, by the method of installation of the segmented foundation-anchoring and support assembly of the present invention, segments 100, 140, 170, and anchoring head assembly 190 are brought disassembled to the site where the installation of the anchoring assembly 200 is to take place. Substantial shipping costs are saved by utilizing the segmented foundation anchoring and support assembly of the present invention.

By bringing to the installation site a number of each, top, middle, bottom segments, anchoring head assemblies, lengths of rod 112, and couplings 152, a large number of segmented anchoring assembly lengths can be assembled easily. By the conventional method, an individual one-piece anchor is brought to the foundation installation site for each foundation size, i.e., for each foundation length, to be installed. This conventional method requires substantially greater shipping and overall costs in comparison to the present invention.

In addition, if an unexpectedly longer anchoring and support assembly is required, e.g., because of unexpected soil conditions, such length can be assembled easily on site in the field by combining a number of four-foot top segments, with a number of one to three-foot middle segments and a four-foot bottom segment. "Dywidag" rod 112 can be extended easily, to the desired length, by means of "Dywidag" couplings 152, 216. The unexpected required length problem is eliminated easily by the method of the present invention.

Continuing to describe the method of installation of the segmented anchoring and support assembly of this invention, reference now is made to FIG. 8. An earthen hole 101 is augered by the operator or by a drilling contractor. Earthen hole 101 is drilled to the required depth, which depends on the length of the SAFE Foundation 210, (FIGS. 11 and 12), the mechanical characteristics of soil 111, and the depth of the watertable in soil 111, by way of examples.

In the great majority of cases, the characteristics of the soil is determined in advance, whether it be for the installation of a SAFE Foundation, a concrete foundation, or any other type of foundation. In fact, a foundation is engineered based upon two main groups of elements. The mechanical characteristics of the structure to be supported by the foundation determine the various loads the foundation will support, i.e., uplift and compression loads, lateral and moment loads, and torsional loads. Also the mechanical characteristics of the soil depend on where the foundation will be installed. Climatic characteristics play an important role on certain structures as well, e.g., highway signs which are exposed to high winds.

When the soil characteristics are not known in advance, they are determined prior to engineering the foundation. If they are not determined at all, the structural engineer should select the foundation based upon "worst characteristics." In such cases, a foundation larger than actually required is the result and therefore a longer, i.e., deeper earthen hole 101 and a longer anchoring and support assembly 200 are required.

The overall length of pivoting plates 194 also depends on the soil characteristics. By way of an example, weak soils require longer plates 194. Rocky soil requires shorter plates 194.

The installation process continues by assembling onsite in the field the required length of anchoring and support assembly 200.

Segments 100, 140, and 170, in the required number needed to meet the required depth of earthen hole 101 are placed first over "Dywidag" rod 112, i.e., "Dywidag" rod 112 passing through the inside of segments 100, 140, and 170. Anchoring head assembly 190 is assembled at the shop, by installing its "Dywidag" rod 112 on its head assembly 190 portion, prior to shipping to the foundation installation site. "Dywidag" rod 112 is extended easily by means of a "Dywidag" coupling 152, 216, as shown in FIGS. 4*a* and 11, respectively.

Now segments 100, 140, and 170 are bolted easily together by the installation workers, by means of bolts 201 of flanges 105 and 141, and by bolts 202 of flanges 147 and 171 as shown in FIG. 8.

Next, pivoting plates 194 of anchoring head assembly 190 are brought manually to a position parallel alongside rod 112. Then, by pulling on rod 112, which also pulls up "Dywidag" nut 198, which in turn pulls up frusto-cone 197, the operator adjusts the position of frusto-cone 197 to a point where the top of frusto-cone 197 touches the bottom of pivoting plates 194. When the operator pulls rod 112, nut 198 pulls frusto-cone 197 as well, because nut 198 is threaded at the bottom end of rod 112.

The operator now ties pivoting plates 194 by wrapping all four plates 194 (only three shown) with breakable tie wire (not shown). After plates 194 are tied, the larger diameter of frusto-cone 197 is greater than the overall diagonal measurement of the four tightened pivoting plates. Then the operator hand tightens nut 132 against plate 110 of the anchoring and support assembly to keep frusto-cone 112 immobilized in that position. This procedure is labeled "pivoting plates adjustment," because it establishes the precise distance, i.e., length, required to extend pistons 129 of hydraulic assembly 125, out of their respective cylinders 128, in order to produce a forty-five degree pivoting movement of pivoting plates 194 away from their tightened, parallel position (with respect to rod 112) and still maintain a gap 204 of one quarter of one inch to one half of one inch in between the top "Dywidag" nut 199 and the bottom of support frame 196, after frusto-cone 197 is pulled up by hydraulic assembly 125 during the installation process. This gap 204 is required later during the process of installation of SAFE Foundation 210 of FIGS. 11 and 12.

The operator carefully measures and records the distance between the top of nut 199 and the bottom of support frame 196 after completing the pivoting plates adjustment. That distance depends on the length of pivoting plates 194, which in turn depends on the soil characteristics.

Anchoring and support assembly 200 of FIG. 8 is lowered inside pre-augered, vertical earthen hole 101 by means of hook 120, FIG. 10, of truck mounted hydraulic boom (not shown) and utilizing a wire-rope choker 119, FIG. 10, hooked onto choker openings 114 on plate 110 of FIG. 7 or by means of devises 118, through holes 109 on fins 103 of FIG. 10.

The length of foundation anchoring and support assembly 200 is six to twelve inches longer than the depth of earthen hole 101 or six to twelve inches longer than the final grade top plate 214 of foundation 210, of FIGS. 11 and 12, after the installation of completed foundation 210. The combined length of pipe column 100, 140, 170, after they are assembled should be at least one foot greater than the overall length of the foundation to be installed.

After the anchoring and support assembly 200 is inside earthen hole 101, centering collar 113 is placed over the protruding six to twelve inches of top segment 100. Collar 113 is utilized for ensuring the anchoring and support assembly stays vertically plumb inside earthen hole 101. Collar 113 is about one to one and one half feet long. Collar 113 has plate 114 welded to it. Plate 114 rests on top of surface 203 of soil 111, while collar 113 is placed inside and at the top of earthen hole 101. Through-holes 115 on plate 114 allow inserting pins 116 through them and into soil 111, by hammering. Pins 115 immobilize collar 113 in place.

Anchoring head assembly 190 rests at the bottom of earthen hole 101, with pivoting plates 194 tied down, by breakable tie-wire (not shown) and in a vertical position, parallel to rod 112 of anchoring assembly 190.

Now the operator places hydraulic assembly 125, over rod 112 utilizing a crane (not shown), and sets it on top of plate 110. Plate 126 of the hydraulic assembly 125 sits on top of plate 110 of the segmented anchoring and support assembly, while rod 112 passes through opening 136 of plate 126 and through opening 137 of plate 127, as shown in FIG. 8.

Steel plate washer 138 is placed on top of top plate 127 of hydraulic assembly 125, with rod 112 passing through a center hole in plate 138. "Dywidag" nut 133 then is threaded down on "Dywidag" threaded rod 112 and hand tightened against plate washer 138 and plate 127. Plate washer 138 is required for covering opening 137, on plate 127, because opening 137 is larger in diameter than nut 133 in order to allow "Dywidag" coupling 216 of FIG. 11 pass through it when and if rod 112 requires to be extended and when installing foundation 210, of FIG. 11.

Continuing to refer to FIG. 8, now the operator activates hydraulic cylinder assembly 125 by means of a hydraulic fluid pumping system, which includes, by way of an example, at least, a hydraulic pump (not shown), hydraulic fluid-carrying hoses 118, 119, a pressure gauge 117, and controls (not shown).

The hydraulic pump (not shown) pumps hydraulic fluid into cylinders 128, through hoses 118, via their inlets 130. This pumping forces pistons 129 out of cylinders 128. Both pistons 129 are attached to top plate 127. Top plate 127, therefore, is pushed upwardly, encountering the resistance of "Dywidag" threaded nut 133, which is threaded on "Dywidag" threaded rod 112. As a result, the upward moving force of pistons 129 pull rod 112 upwardly as represented by arrows 134, with a force of approximately eighty tons, which is the allowable force for the anchoring and support assembly.

Since frusto-cone 197 is at the bottom end of rod 112 and prevented from falling down by means of "Dywidag" threaded nut 198, which is threaded onto rod 112, the slow yet powerful upward pull on rod 112 by pistons 129 also pulls frusto-cone 197 upwardly. The powerful, slow, upward pull of frusto-cone 197 then is transferred to, i.e., exerted on, pivoting plates 194, forcing them to break easily the tie-wire (not shown) that kept them vertically down and parallel to "Dywidag" rod 112. As rod 112 is pulled up by pistons 129, threaded nut 132 is carried up with it. The operator threads nut 132 down, in order to keep it hand tightened against plate 110.

Frusto-cone 197, because of its geometry, pushes pivoting plates 194 away from their original vertical position. Pivoting plates 194 are forced by the powerful upward advance of frusto-cone 197, and swing, i.e., move upwardly, rotating about their respective bolts 195 on structural support frame 196.

The upward swing of the four pivoting plates 194 (only three are shown) strongly forces pivoting plates 194 to compact and consolidate soil 111 at the bottom of earthen hole 101, effectively transferring the powerful upward force of hydraulic cylinder assembly 125 onto the soil at the bottom of earthen hole 101, thus anchoring the foundation anchoring and support assembly 200 at the bottom of vertical earthen hole 101. Dywidag nut 132 tightened against plate 110 prevents the anchoring head assembly 190 from falling back down.

The assembled segments 100, 140, 170, and collar 191 with plate 193 are welded to structure support frame 196, and become one combined piece that supports the hydraulic assembly 125 upon it, i.e., upon the assembly, so that the upward force of pistons 129 is exerted upon rod 112 and thus upon plates 194 and ultimately upon the soil at the bottom of earthen hole 101.

The operator measures and records the distance between the top end of frusto-cone 197 and the bottom of support frame 196, after adjusting the top of frusto-cone 197 firmly to touch the ends of pivoting plates 194 which were tieddown by wrapping breakable tie-wire around them and before expanding pivoting plates 194.

It has been found empirically, after performing a multitude of tests, that the preferred anchoring position is achieved when at the desired level of force pivoting plates 194 have swung to a forty-five degree position with respect to their original vertical position, i.e., the position prior to any force being applied to them by cylinder assembly 125. As a result of many trials and errors, it has been found empirically that the forty-five degree position of pivoting plates 194 is achieved, when frusto-cone 197 has been pulled-up, by rod 112 and nut 198, for a distance equal to the measured distance less approximate one half of one inch. This additional one half of one inch, gap 204, is required later-on, after installing foundation 210 of FIG. 11, in order to allow the unthreading of nut 132. Therefore, the operator watches very carefully the slow, upward movement of pistons 129, and he/she stops the upward movement of pistons 129, by stopping the hydraulic pumping system, when pistons 129 have extended out of cylinders 128 for a distance equal to the recorded measurement less than one half of one inch gap 204. It should be noted that, if the operator did not stop the upward pull of frusto-cone 197, nut 199, FIG. 6*a*, eventually would hit the bottom of support frame 196. If that happens, the hydraulic force then would be exerted against the finned pipe column 100, 140, 170, and frame 196, instead of plates 194.

It has been found that one of the many drawbacks encountered with the anchoring assembly, the old art assembly used the fact that frusto-cone can hit the bottom of structural support frame as the signal to the installer indicating that pivoting plates 194 had swung outwardly forty-five to fifty-five degrees from their original vertical position. In fact, in U.S. Pat. No. 4,843,785, dated Jul. 4, 1989, this trouble-creating feature is diclosed, as follows, (referring to FIG. 1): "Section 16 can constitute a mechanical stop and serve as limiting means to limit the angular spread accomplished by Section 18." and claim 7: "The apparatus of claim 1 including swing limiting means to limit the swing of said plates to an arc of substantially 55 degrees."

The major problem with the frusto-cone hitting the bottom of structural support frame 196 is that hydraulic assembly 125 pushes against segments 100, 140, and 170, with collar 177, plate 193, and support frame 196 sandwiched in between segment 170 and frusto-cone 197, hitting the bottom end of support frame 196. Under these circumstances, any force provided by the hydraulic assembly 125 is not exerted upon pivoting plates 194, i.e., not exerted upon the soil, but upon support frame 196. Any gage reading is a false indication of the anchor setting force and, therefore, a false reading of the installation capabilities.

Continuing now to describe the installation method of the present invention, the operator all this time has been readjusting, i.e., threading down, nut 132. After he/she stops the hydraulic pump (not shown), the operator ensures that nut 132 is hand tightened against plate 110 of top segment 100 in order to prevent pivoting plates 194 from falling back down when the operator releases the upward pull of pistons 129.

Before turning off the hydraulic pumping system, i.e., before deactivating hydraulic assembly 125, the operator reads and records the hydraulic pressure at the final setting of anchoring assembly 200. The actual reading is taken from hydraulic pressure gauge 117, and it represents the capability of the installed anchor to resist the design structural loadings. Such reading is generally in pounds per square inch of hydraulic pressure. Based on the diameter of pistons 129, the pound per square inch, or P.S.I., can be mathematically converted to tons-force. The operator does not make calculations by the method of the present invention. The operator is provided with a tabulation, i.e., a printed table, showing the equivalent tons-force for various P.S.I. readings for the hydraulic assembly being used. The operator records the final tons-force used for setting, i.e., for anchoring the segmented foundation anchoring and support assembly of the present invention inside earthen hole 101. The maximum reading shall never be allowed to be greater than the allowable force for the anchoring assembly.

This maximum reading represents the maximum resisting capacity of the installed-segmented anchoring and support assembly of this invention. This knowledge is important, because if the SAFE Foundation to be installed requires a greater amount of force for its installation, the operator immediately knows he or she will need to use additional segmented anchoring assemblies 230, as shown in FIG. 12.

After segmented anchoring assembly 200 of FIG. 8 has been installed, by anchoring it in earthen hole 101, hydraulic assembly 125 is removed first by retracting pistons 129 back inside their respective cylinders 128, and by releasing any hydraulic pressure from the system. Then nut 133 is unthreaded, plate washer 138 is removed, and finally hydraulic assembly 125 and centering collar 113 also are removed.

Method of Installation of a Safe Foundation Utilizing the Segmented Anchoring and Support Assembly of the Present Invention Referring now to FIG. 11, while segmented anchoring assembly 200 is assembled, the installation crew makes one inch and one foot marks (not shown) on the fin 215, of foundation 210, that will face the operator. Starting from bottom end 222, the fin is marked in one-inch intervals with a magic marker, by the way of an example, and with larger marks at one-foot intervals, starting from the bottom. These markings allow the operator to see how many feet and inches foundation 210 penetrates soil 111 as it is being pushed into it.

Continuing now to refer to FIG. 11, rod 112 now is extended, if it has not been extended before, by means of "Dywidag" coupling 216 and a length of rod 217. Foundation 210 is lifted then by means of a crane (not shown) and placed over rod 217/112, i.e., with the "Dywidag" rod passing inside pipe column 218 of foundation 210 and the top portion of anchoring and support assembly 200 inside bottom end 222 of foundation 210. Bottom end 222 at this point is set on top of hole 101, with the bottom end of fins 215 slightly pressed into surface 203 of soil 111 around the top of earthen hole 101.

Preferably, fins 215 of foundation 210 should be at forty-five degrees to pivoting plates 194 of anchoring and support assembly 200. FIG. 11 does not show fins 215, of foundation 210 at a forty-five degree angle to pivoting plates 194 for simplification purposes. The installer determines the position of pivoting plates 194, because the installer sets pivoting plates 194 an orientation in reference to fins 103, 145, 175 of anchoring and support assembly 200, before lowering assembly 200 in earthen hole 101. Therefore, by looking at fins 103 of protruding top segment 100, the operator sets the orientation of pivoting plates 194, such that each pivoting plate 192 becomes established to be set in line with a corresponding fin of the anchoring and support assembly, by the method of this invention.

The type of structure to be installed upon a SAFE Foundation is the determining factor that sets the orientation at which fins 215 are placed into soil 111 and the orientation of pivoting plates 194 set inside hold 101, prior to swinging open plates 194, i.e., while in a vertical position, preferably so as to, have fins 215 at a forty-five degree angle to pivoting plates 194 when in a vertical position, i.e., with each fin 215 lined in between two adjacent pivoting plates 194.

After foundation 215 has been placed over rod 217 by means of a crane (not shown) and with its end 222 on ground surface 203, and pipe column 218 centered around the protruding top of segmented anchoring and support assembly 200, pushing collar 211 is placed by means of a crane (not shown), over rod 217, i.e., with rod 217 passing through the inside 219 of pushing collar 211 and with plate 213 of pushing collar 211 sitting on top of foundation plate 214.

Pushing collar 211 is required because, by the method of installation of this invention, segmented anchoring and support assembly 200 is installed with six to twelve inches of its top end protruding above surface 203 of soil 111 in earthen hole 101, as shown in FIG. 8. Pushing collar 211 provides a safety space to prevent plate 126 of hydraulic assembly 125 from hitting top plate 110 of top segment 100 of the segmented anchoring and support assembly.

Now hydraulic cylinder assembly 125 is placed also by means of a crane (not shown) over rod 217. Extended rod 217 passes through opening 136 of bottom plate 126 and through opening 220 of top plate 127. Then steel plate washer 138 also is placed over rod 217, which passes through a center hole in plate washer 138. Washer 138 is provided for allowing tightening "Dywidag" nut 133 against hydraulic assembly 125, while preventing it from passing through opening 220 of plate 127 on hydraulic assembly 125.

"Dywidag" nut 133 is threaded down on "Dywidag" rod 217 and hand-tightened against plate washer 138, which is on top of plate 127 of hydraulic assembly 125.

The operator activates the hydraulic pump (not shown), which pumps in hydraulic fluid through hoses 118, through inlet 130 and out of 131 through hose 119, making pistons 129 slowly, yet powerfully push upwardly against nut 133, as represented by arrow 134. Nut 133, being threaded onto rod 217, does not allow pistons 129 to move upwardly. Pistons 129 push upwardly against "Dywidag" nut 133, actually to lift threaded rod 217, 112 up, which in turn makes "Dywidag" nut 198 push on frusto-cone 197, and frusto-cone 197 pushes on pivoting plates 194. The powerful upward push 134 of pistons 129 actually is exerted upon pivoting plates 194. But because pivoting plates 194 have been pressed previously, powerfully against soil 111 at the bottom of earthen hole 101, as shown in FIG. 11, "Dywidag" rod 112 can not be lifted. Soil 111 resists the push provided by pistons 129. Cylinders 128 move downwardly slowly, yet powerfully, as represented by arrows 135, pressing on pushing collar 211 and therefore on foundation 210, by means of its top plate 214. The powerful push of pistons 129 against "Dywidag" nut 133, resisted by the soil at the bottom of earthen hole 101, forces cylinders 128 to push foundation 210 into the soil.

If the force required to push foundation 210 into the soil is greater than the allowable force the segmented anchoring and support assembly can take without deformation, then it is required to install additional pairs of segmented anchoring and support assemblies, also called segmented satellite anchors 230, as shown in FIG. 12.

If soil 111 can not provide the resistance to the force required to push foundation 210 into soil 111, then additional pairs of segmented satellite anchors 230 are required as shown in FIG. 12.

As hydraulic assembly 125 pushes foundation 210 into soil 111, the operator monitors the stroke, i.e., length of pistons 129 that has extended out of cylinders 128. The operator compares that length, i.e., stroke, to the length foundation 210 has penetrated into soil 111 by reading the markings the operator had previously made on the fin 215 facing he or she. Both lengths are to be substantially equal. If the pistons have extended more than what the foundation has penetrated into the soil, it means segmented anchoring and support assembly 200 has been pulled up from hole 101 for a length which is equal to the difference between the two compared lengths, i.e., the length pistons 129 have extended less the length foundation 210 has penetrated into the soil below surface 203.

In such a case, where the segmented anchoring and support assembly 200 is pulled out of earthen hole 101 while installing a SAFE Foundation, the operator immediately stops the hydraulic pump (not shown) and proceeds to install additional pairs of segmented satellite anchoring and support assemblies, as shown in FIG. 12. If the stroke of cylinders 129 and the length foundation 210 substantially are equal, then the operator proceeds with another pushing cycle.

Pistons 129 of FIG. 11 can extend out of cylinders 128 only a maximum allowable length, e.g., two feet, by way of an example. SAFE Foundations can be of any length, up to twenty-five feet, by way of an example. If a twenty-four foot long foundation is being installed with a two-foot-stroke set of pistons 129, then the pushing process has to be repeated at least twelve times, because each time pistons 129 extend out of cylinders 128 for their maximum two feet stroke (used as an example), foundation 210 will be pushed into soil 111 for substantially close to two feet.

Before starting a new pushing cycle, the operator reverses the flow of hydraulic fluid from the hydraulic pump (not shown), by pumping the hydraulic fluid out of 130 and pumping it into inlet 131. That pumping forces pistons 129 to retract into their respective cylinders 128, bringing down top plate 127 and plate washer 138. When pistons 129 are inside their respective cylinders, the operator stops the hydraulic pump. Next, the operator threads down "Dywidag" nut 133 on "Dywidag" extended rod 217 and hand-tightens nut 133 against plate washer 138, which is against plate 127 of hydraulic assembly 125.

Now the operator starts a new pushing cycle by reversing again the flow of hydraulic fluid, by starting to pump the fluid out of 131 and back into inlet 130, forcing pistons 129 to push powerfully against "Dywidag" nut 133, as represented by arrows 134. Again, this powerful push is resisted by the soil at the bottom of earthen hole 101, forcing cylinders 128 slowly, yet powerfully, further to push foundation 210 downwardly as represented by arrows 135.

The pushing cycles are repeated until top plate 214 of foundation 210 is at the elevation required for the installation of the structure to be mounted on it, i.e., supported by it. Top plate 214 is utilized for installing upon it whatever structure is to be supported by the foundation, e.g., lighting poles, communication towers, cross-highway signs, by way of examples. The operator monitors the pressure and records the final setting pressure in the foundation installation records.

After foundation 210 has been installed, i.e., pushed into the ground, with its top plate 214 at the specified elevation, by the methods of this invention, pistons 129 are brought back into their respective cylinders 128. The hydraulic system is deactivated, any pressure in the system is released, and "Dywidag" nut 133 and plate washer 138 are removed. "Dywidag" "extension rod 217 and coupling 216 also are removed. Then hydraulic cylinder assembly 125 and pushing collar or collars 211 all are removed utilizing a crane (not shown).

Now, if no segmented satellite anchor is required, segmented anchoring and support assembly 200 can be removed. In order to remove anchoring and support assembly 200 through the inside of pipe column 218 of foundation 210, it is necessary to release the pressure exerted by pivoting plates 194 upon soil 111 at the bottom of earthen hole 101. In order to do that, first hydraulic cylinder assembly 125 is lifted up by means of a crane and placed on top of plate 214 of foundation 210, washer plate 138 is replaced on top of plate 127 of the hydraulic assembly, and "Dywidag" nut 133 is threaded unto rod 112 and hand tightened against plate washer 138, which is against plate 127. The operator activates the hydraulic pump, pumping hydraulic fluid into cylinders 128, via hoses 118 and inlets 130, extending pistons 129 which upwardly push "Dywidag" nut 133 against top plate 214 of foundation 210 by means of the bottoms of cylinders 128 on top of plate 214 lifting rod 112 just enough to release the large pressure exerted on nut 132, allowing the operator to unthread nut 132. The upward movement of rod 112 of about one quarter of one inch is possible because during the installation of segmented anchoring assembly 200, a gap 204, FIGS. 8, 11, of approximately one quarter to one half of an inch was left between the top of nut 199, on top of frusto-cone 197 and the bottom of structural support frame 196, precisely for this purpose; in other words, allowing pulling "Dywidag" rod 112 up for about less than one half of one inch with the purpose of unthreading nut 132 starts collapsing pivoting plates 194 back down to their original vertical position, so that the whole anchoring assembly of this invention is extracted through the inside of pipe column 218 of foundation 210 as shown in FIG. 10. The segmented anchoring and support assembly of this invention is re-utilized again and again.

Now the hydraulic systems is deactivated again, releasing the pressure on pistons 129. Nut 133 and plate washer 138 are removed again, and hydraulic assembly 125 is lifted up, so that its plate 127 is above the top end of rod 112 coupling 216 and extension rod 217 were removed previously. The operator then re-installs plate washer 138, this time on top of nut 132, FIG. 9, and lowers down hydraulic assembly 125 allowing rod 112 pass through opening 220 of plate 127.

Next the operator re-activates the hydraulic pump, extending pistons 129 upwardly, for a distance equal to the distance the operator used for swinging pivoting plates 194, when he/she installed the segmented anchoring and support assembly. The operator has that measurement written in his installation records.

Then, nut 132 is threaded upwardly on rod 112, hand tightening plate washer 138 now against the bottom of plate 127 of hydraulic assembly 125, as shown in FIG. 9. The operator then reverses the flow of hydraulic fluid, pumping the fluid through hoses 119, into inlets 131 and out of 130, via hoses 118, which makes pistons 129 push forcefully downwardly as represented by arrow 117 of FIG. 9, exerting their push on plate washer 138 as they retract into their respective cylinders 128 and therefore on nut 132 threaded onto rod 112. Rod 112 moves downwardly under the forceful push of pistons 129, carrying down with it nut 199 of FIG. 6*a*, which is threaded onto rod 112, on top of frusto-cone 197, therefore pushing down on frusto-cone 197. The downward push on frusto-cone 197 further releases pivoting plates 194, which are now free to swing back down to their original vertical position.

Referring to FIG. 10, now the operator lifts up segmented anchoring and support assembly 200, utilizing a standard wire-rope choker 119, with one-heavy-duty clevis 118 on each end, bolted through holes 109 of fins 103, by means of lifting hook 120 of a crane, not shown, or other similar type of equipment. Sometimes a great amount of upward pulling force is required to collapse pivoting plates 194 of FIG. 11 back to their original vertical position, which is necessary in order for anchoring head assembly 190 to pass through the inside of pipe column 218 of foundation 215 of FIG. 11. Incline ramps 206, FIG. 11, help in centering the anchoring head assembly inside pipe column 218.

After removing the segmented anchoring and support assembly, it can be reused immediately for installing a similar SAFE Foundation, or it can be modified easily in length by adding or removing segments and "Dywidag" rods lengths in order to meet new SAFE Foundation requirements.

The spoils (not shown) created when earthen hole 101 was augered are now placed, some around the top end of foundation 210 and the majority of it placed inside pipe column 218 of foundation 210. The SAFE Foundation then is ready to receive whichever structure it was intended to be installed upon it, by bolting onto the foundation top plate 214.

Method of Installation of a Safe Foundation Utilizing the Segmented Satellite Anchoring and Support Assemblies of the Present Invention The method of installation of a SAFE Foundation or any tubular type foundation, utilizing satellite anchors is described referring to FIG. 12, which teaches such installation method utilizing three segmented anchoring and support assemblies 200, 230. FIG. 12 shows two segmented satellite anchoring and support assemblies 230 and a central, segmented anchoring and support assembly 200. Anchoring assembly 200 is called the center anchor or center anchor 200 for the purpose of this detailed description.

Satellite anchoring assemblies 230 are substantially identical in configuration to center anchor 200. Most of the times, satellite anchors 230 are shorter in length than center anchor 200.

The method of installation and subsequent removal of satellite anchors 230 is not different from the method of installation and of removal of center anchor 200. The installation of the SAFE Foundation utilizing satellite anchors will assume all anchors already have been installed by the method of the invention.

By the methods of the present invention, center anchor 200 of FIG. 12 and each satellite anchor 230 first are installed in their respective preaugered earthen holes 101, 245, 246. Prior to installing foundation 210, satellite anchors 230 are installed at a distance from center anchor 200 and one on each opposite side. Satellite anchors 230 are installed on a centerline that passes through the center of earthen hole 101. A second pair of satellite anchors, if required, would be installed on a centerline that passes over the center of earthen hole 101 and that is perpendicular to the first pair. In other words, a satellite anchor of the second pair would be at ninety degrees to a satellite anchor of the first pair. Further additional pairs would be installed on a centerline that passes over the center of earthen hole 101, with those satellite anchors being at forty-five degrees to the two adjacent satellite anchors.

Referring now to FIG. 11, the operator begins the installation process utilizing at first only one single segmented anchoring and support assembly, i.e., center anchor 200. He or she pushes foundation 210 into soil 111, by means of hydraulic assembly 125 as far as it is possible, until either center anchor 200 starts pulling out of earthen hole 101, which he or she determines by comparing the length foundation 210 has been pushed below surface 203, with the length pistons 129 are out of cylinders 128, or until the pushing force of pistons 129 approaches the allowable force the single anchoring assembly 200 can resist, i.e., approximately 80 tons. The operator reads the pressure in P.S.I., i.e., pounds per square inch, on the pressure gauge 117 component of the hydraulic pumping system and reads the equivalent tons-force from a conversion table.

When the operator determines satellite anchors 230 are required for further pushing foundation 210 into soil 111, he or she deactivates the hydraulic system and releases the hydraulic pressure on pistons 129. The operator then removes nut 133 by unthreading it off from extension rod 217 and then removes plate washer 138, FIG. 11.

Referring now to FIG. 12, the operator places sliding plates 241 inside boxes 240, one on each end of I-Beam assembly 234, then he/she picks up beam assembly 234 by means of a crane or a boom-truck (none shown) and places I-Beam assembly 234 over extension rod 217, slowly and carefully lowering beam assembly 234 until it sits on top of plate 127 of hydraulic assembly 125 and with extended rod 217 passing through hole 249 of plate 247. Flanges 244 (only one is shown) sit on top of plate 127.

The operator now proceeds to extend rods 112 of each satellite anchor 230 by means of couplings 232 and by threading a length of extension rod 233 into couplings 232. The operator at his/her choice either inserts extension rods 233 from underneath beam assembly 234 to pass through hole 250 of each sliding plate 241 (one on each end of beam assembly 234), or he/she inserts extension rods 233 from above beam assembly 234 to pass through holes 250 of each sliding plate 241. Either way, extension rods 233 are threaded into their respective couplings 232. Then nuts 133, 242 are threaded down onto their respective extension rods 217, 233 and tightened against their respective plates 241, 247. During the entire installation procedure, by the method of this invention, the operator makes sure foundation 210 is vertically plumb and that each component tool, i.e., pushing collar 211, hydraulic cylinder assembly 125, and I-Beam assembly 234 are also vertically plumb, i.e., leveled.

Next the operator continues the pushing cycles required to complete the insertion of foundation 210 into soil 111. The operator activates the hydraulic pumping system and pumps hydraulic fluid via hoses 118 into inlets 130 of hydraulic assembly 125, which forces pistons 129 to push upwardly against bottom flanges 244 (only one shown) of I-Beam assembly 234 as represented by arrows 134. I-Beam assembly 234 is immobilized by "Dywidag" nuts 133, 242 of center anchor 200 and satellite anchors 230 respectively. Pistons 129 can not move upwardly. Cylinders 128 are the ones that move downwardly instead, as represented by arrow 135, pushing down on pushing collar 211 by means of plate 126 of hydraulic assembly 125, pushing down on plate 212. This powerful downward push is transferred onto foundation 210, by means of plate 213 of pushing collar 211, which is sitting on top of plate 214 of foundation 210, slowly, yet forcefully pushing foundation 210 into soil 111.

The operator watches the advance of foundation 210 into soil 111, past its surface 203, by watching the inch/feet marks previously made on the fin 215 facing the operator, as described in this text. The operator compares the length foundation 210 has been pushed below surface 203 with the length pistons 129 have extended out of cylinders 128. Both lengths are to be substantially equal. In some occasions, a second pair of satellite anchors 230 and an additional I-Beam assembly are required. The required number of components are brought to the installation site prior to starting the installation process, all by the methods of the present invention.

The pushing cycles, utilizing I-Beam assembly 234 are repeated until foundation 210 is pushed into soil 111, to the required elevation specified for its top plate 214 to be at. The operator records in its installation record the final setting pressure at which the installation was completed. The final setting pressure proves the capability of the foundation of carrying its design load with the design marging of safety.

The operator then retracts pistons 129 back into their respective cylinders 128 and deactivates the pumping system after that. Then he/she removes "Dywidag" nuts 133, 242 and the I-Beam assembly 234. Extension rods 217, 233 and couplings 216, 232 are removed, while hydraulic assembly 125 and pushing collar 211 also are removed.

Next, the operator extracts center anchor 200 through the inside of pipe column 218 of foundation 210 by the method of this invention. Then some of the spoils from previously augering earthen hole 101 are packed around the top of pipe column 218 of the foundation, and the balance is placed inside pipe column 218.

Next, satellite anchors 230 also are removed, following the method of this invention. Satellite anchor assemblies 230 are extracted from their respective earthen holes 245, 246, and the spoils from previously augering earthen holes 245, 246 are placed back into their respective earthen holes, and compacted afterwards.

Now the structure, for which foundation 210 was engineered, can be installed upon installed the foundation by bolting onto the foundation's top plate.

As it can be seen by those skilled in the art, this invention accomplishes all of its stated objectives.

What is claimed is:

1. Anchoring or foundation apparatus to be installed in an earthen hole, comprising:

(a) a vertical segmented support means; and (b) a plurality of spaced media consolidation plates swingably mounted about respective pivot points on said vertical support means, said plates having media-facing surfaces swingable outwardly from said vertical support means into the surrounding media.

2. Anchoring or foundation apparatus to be installed in an earthen hole as set forth in claim 1, comprising varying segmented lengths to form said segmented vertical support means.

3. Anchoring or foundation apparatus to be installed in an earthen hole as set forth in claim 2, further comprising a centering collar.

4. Anchoring or foundation apparatus to be installed in an earthen hole as set forth in claim 3, further comprising an anchor positioning means at level force pivoting plates.

5. Anchoring or foundation apparatus to be installed in an earthen hole as set forth in claim 4, wherein said pivoting plates are positioned 40-50 degrees from vertical.

6. Anchoring or foundation apparatus to be installed in an earthen hole as set forth in claim 5, wherein said pivoting plates are positioned 45 degrees from vertical.

7. Anchoring or foundation apparatus to be installed in an earthen hole as set forth in claim 5, further comprising frusto-cone.

8. Anchoring or foundation apparatus to be installed in an earthen hole as set forth in claim 7, said frusto-cone having a predetermined gap distance.

9. Anchoring or foundation apparatus to be installed in an earthen hole as set forth in claim 8, wherein said predetermined gap distance is one-half inch.

10. Anchoring or foundation apparatus to be installed in an earthen hole as set forth in claim 9, wherein said predetermined gap distance forms a gap.

11. A method for installing an anchor for a foundation device in the earth, comprising:

(a) preparing a hole in the earth;

(b) lowering into said hole a segmented anchor or foundation device having swingable media facing plates and a segmented vertical support formed of segmented lengths; and (c) applying force to swing said plates outwardly into the surrounding media.

12. A method for installing an anchor for a foundation device in the earth as set forth in claim 11, further comprising varying the segmented lengths to form said segmented vertical support.

13. A method for installing an anchor for a foundation device in the earth as set forth in claim 12, further comprising positioning a centering collar.

14. A method for installing an anchor for a foundation device in the earth as set forth in claim 13, further comprising positioning said anchor at level force pivoting plates.

15. A method for installing an anchor for a foundation device in the earth as set forth in claim 14, further comprising positioning pivoting plates 40-50 degrees from vertical.

16. A method for installing an anchor for a foundation device in the earth, as set forth in claim 15, further comprising positioning pivoting plates 45 degrees from vertical.

17. A method for installing an anchor for a foundation device in the earth as set forth in claim 15, further comprising providing a frusto-cone.

18. A method for installing an anchor for a foundation device in the earth as set forth in claim 17, further comprising positioning said frusto-cone a dx equal to a predetermined distance.

19. A method for installing an anchor for a foundation device in the earth as set forth in claim 18, wherein said predetermined distance is one-half inch.

20. Anchoring or foundation apparatus to be installed in an earthen hole, comprising:

(a) central segmented rod means;

(b) plate assembly means mounted around said rod means;

(c) pipe column means around said central segmented rod means positioned above said plate assembly means;

(d) a plurality of circumferentially spaced media consolidation plates said plate assembly means;

(e) swing means on said media facing surfaces pivotally mounted and swingable outwardly about respective pivot points in a substantially vertical arc;

(f) spreader means adapted to swing said plates outwardly into the surrounding media upon relative vertical movement between said pipe column means and said rod means to spread said plates to an arc of no more than about 55 degrees;

(g) restrainer means to restrain said plate assembly means from vertical movement; and (h) force applying means adapted to provide relative vertical movement between said pipe column means and said rod means.

* * * * *